United States Patent [19]

Lee

[11] Patent Number: 4,975,691

[45] Date of Patent: Dec. 4, 1990

[54] SCAN INVERSION SYMMETRIC DRIVE

[75] Inventor: James Y. Lee, Irvine, Calif.

[73] Assignee: Interstate Electronics Corporation, Anaheim, Calif.

[21] Appl. No.: 63,179

[22] Filed: Jun. 16, 1987

[51] Int. Cl.[5] ..... G09G 3/12

[52] U.S. Cl. ..... 340/781; 340/805; 340/825.81; 315/169.3

[58] Field of Search ..... 340/825.81, 781, 805, 340/811, 812, 802, 718, 719, 727, 753, 754, 784, 792; 315/169.3

[56] References Cited

U.S. PATENT DOCUMENTS

| | | | |
|---|---|---|---|
| 3,432,846 | 3/1969 | Jones et al. | 340/792 |
| 4,152,626 | 5/1979 | Hatta et al. | 340/781 |
| 4,225,807 | 9/1980 | Ise et al. | 340/781 |
| 4,237,456 | 12/1980 | Kanatani | 340/781 |
| 4,479,120 | 10/1984 | Ohba et al. | 340/805 |
| 4,485,379 | 11/1984 | Kinoshita et al. | 340/805 |
| 4,691,144 | 9/1987 | King et al. | 340/805 |

OTHER PUBLICATIONS

T. Kawada et al., "A Symmetric Drive with Low Voltage Drivers for ac TFEL,"*Japan Display*, 1986, pp. 272–275.

Preliminary Data Sheet for Siliconix, "SI9550 34 Channel Symmetric Row Driver".

Preliminary Data Sheet Supertex "HV51/HV52 32 Channel Serial To Parallel Converter With Open Drain Outputs," Apr. 1986.

Preliminary Data Sheet for Supertex "HV53/HV54 32 Channel Serial To Parallel Converter With High Voltage Push-Pull Outputs,".

"SN65563, SN65564, SN75563, SN75564 Electroluminescent Row Drivers,"*Advance Information*, Texas Instruments, May 1986, pp. 1–8.

L. E. Tannas, Jr., "Electroluminescent Displays,"-*Flat-Panel Displays and CRT's*, Van Nostrand Reinhold Company Inc., New York, 1985, pp. 237–288 (ISBN: 0-442-28250-8).

*Primary Examiner*—Alvin E. Oberley

*Assistant Examiner*—Richard Hjerpe

*Attorney, Agent, or Firm*—Knobbe, Martens, Olson and Bear

[57] ABSTRACT

A thin-film electroluminescent display panel system has a plurality of vertical column electrodes driven by column driver circuits and a plurality of horizontal row electrodes driven by row driver circuits. The system includes a row driver control circuit that enables the row drivers in a first sequence during a first display frame so that write voltage pulses are applied to the row electrodes in order from the top to the bottom of the display panel. The row driver control circuit enables the row drivers in a second sequence during a second display frame so that the write voltages are applied to the row electrodes in the reverse order from the bottom of the display panel to the top of the display panel. The alternating sequences of application of the write voltages to the row electrodes cause the average residual dc voltage across each of the pixel elements of the display panel to be substantially reduced towards zero so that latent image problems caused by the residual dc voltage is substantially reduced or eliminated.

7 Claims, 21 Drawing Sheets

COLUMN DRIVE SIGNAL
OUTPUT ENABLE
LATCH ENABLE
DATA
CLOCK
32-BIT SHIFT REGISTER
32-BIT LATCH
SERIAL DATA OUT TO NEXT STAGE
$D_{IN}$
$Q_1$
$Q_2$
$Q_{32}$
$D_1$
$D_2$
$D_{32}$
$D_{OUT}$
120
220
222
224
226
228
230
232
234
240
242
244
246
250
252
254
260

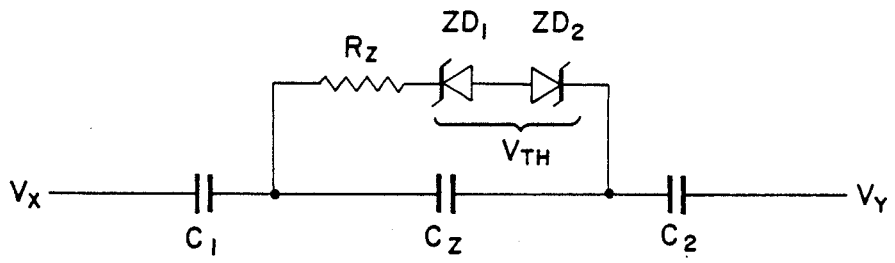
PIXEL CELL EQUIVALENT CIRCUIT
FIG. 12
FIG. 13
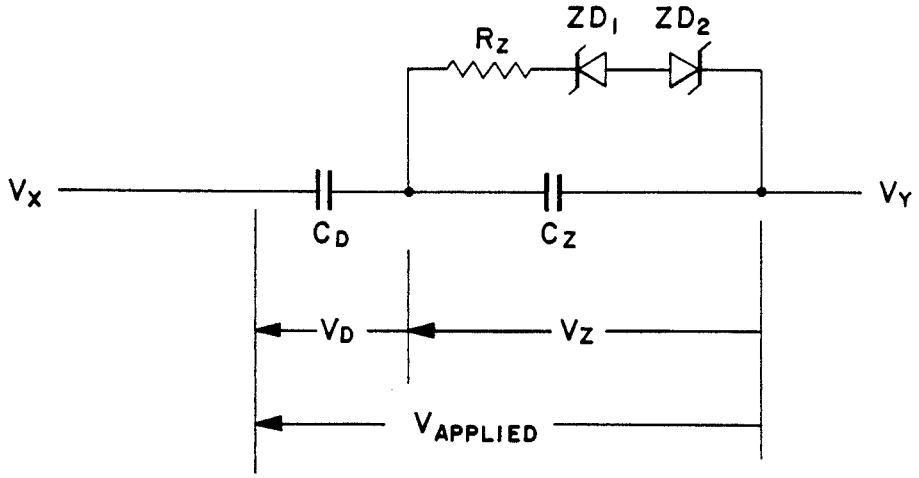
SIMPLIFIED PIXEL CELL EQUIVALENT CIRCUIT HORIZONTAL SCAN SEQUENCER
900
ODD DATA
EVEN DATA
ROW CLOCK
ROW STROBE
ODD LINE
EVEN LINE
EVEN FRAME
ODD FRAME
FIRST COUNTER
SECOND COUNTER
THIRD COUNTER
FOURTH COUNTER
DECODER
ENABLE 4
ENABLE 3
ENABLE 2
ENABLE 1
HSYNC
VSYNC
4 MHz CLOCK
ENABLE ROW
CLR ROW STROBE

SCAN INVERSION SYMMETRIC DRIVE

BACKGROUND OF THE INVENTION

1. Field of the Invention

The present invention generally relates to electronic devices for displaying text and graphics, and, more particularly, to thin-film electroluminescent panels.

2. Description of the Related Art

Electronic displays are used to display the output data from digital computers and other data generating devices, such as television systems, communications systems, and the like. By far, the most well-known and most widely used display device is the cathode ray tube (CRT) which is found in television sets, computer display monitors, and countless other devices in which textual information, graphic information, and/or video images are to be displayed. However, because of the relatively large sizes and weights of CRT's and the electrical power required to drive them, there has been extensive research and development directed towards replacement devices that provide the same or similar functions in a so-called "flat panel" device. Such devices include plasma displays, light-emitting diode displays, liquid crystal displays, and electroluminescent displays. This application is concerned with electroluminescent displays, and, primarily with thin-film electroluminescent displays.

A typical thin-film electroluminescent (TFEL) display panel comprises a matrix-addressed panel of a thin-film phosphor in a thin-film dielectric sandwich. The thin-film phosphor emits light when a large enough electric field is applied across it. For example, an electric field having a magnitude on the order of 2 megavolts per centimeter may be required to cause the phosphor to emit light. The electric field typically is provided by an electrode matrix that comprises a plurality of row electrodes and a plurality of orthogonally positioned column electrodes. The intersections of the row electrodes with the column electrodes define pixel cells. The pixel cells comprise the pixels of the TFEL display. When a voltage having a sufficient magnitude is applied between a row electrode and a column electrode, the phosphor of the pixel cell at the intersection will emit light. The magnitude of the voltage required to cause the phosphor to emit light is the threshold voltage.

In operation, a write voltage pulse is applied to the row electrodes, one row at a time (e.g., row one, followed by row two, and so forth). The write voltage pulse applied to the "addressed" row electrode (e.g., the first row) is below the threshold and is thus insufficient by itself to cause the phosphors of the first row to emit light. At the same time that the write voltage pulse is applied to the selected row electrode, a modulation voltage pulse is applied to each column electrode. If the pixel cell at the intersection of the addressed row and a column is to emit light, the modulation voltage pulse applied to the column is selected to be sufficient, when added to the write voltage pulse applied to the row, to be above the threshold voltage for the phosphor so that the pixel cell emits light. On the other hand, if a pixel cell is to remain off, the corresponding column modulation voltage is selected to be zero volts or some other voltage that, when added to the write voltage pulse applied to the row, is below the threshold voltage of the phosphor. After the first row has been written, the write voltage pulse is applied to the next row (e.g., row two), and a modulation voltage pulse is applied to each column to cause the phosphors of selected pixel cells in the second row to emit light. The sequence is repeated for each row until an entire frame has been written. In other words, the pixel cells in each of the rows will have been selectively caused to emit light or remain dark.

The phosphors of the TFEL panel typically comprise zinc sulfur manganese, or the like, sandwiched between two dielectric insulating layers. The sandwich structure requires an applied voltage that changes polarity in order to cause the phosphor to emit light. Basically, each of the dielectric sandwiches defining each pixel cell acts as a capacitor having the two electrodes as its plates and the phosphor as part of the dielectric. Thus, although the phosphor will emit light only for a relatively short amount of time after the threshold voltage is applied, the capacitor will remain charged. The voltage charge across a pixel cell will oppose the next application of voltage across the cell and prevent the threshold voltage of the cell from being reached. In order to be able to cause the pixel cell to emit light again, a voltage pulse of opposite polarity to the write voltage pulse is applied to the pixel cell to discharge the capacitance. This opposite polarity voltage pulse, called a refresh voltage pulse, is applied to the pixel cell once for each frame. In many TFEL panel systems, the timing of the refresh voltage pulse is such that two light pulses are emitted during each frame of the data that is displayed on the panel, once when the write voltage pulse is applied and once when the refresh voltage pulse is applied. For example, the refresh voltage pulse is typically applied to the entire panel after the last row in the frame is written so that all of the pixel cells are refreshed at the same time. It should be understood that only the cells to which the write voltage pulse was applied will emit light during the refresh voltage pulse.

It has been found that the foregoing system for refreshing TFEL panels has a problem with image latency. In other words, although a pixel cell has not been activated by the application of a voltage above the threshold voltage, the pixel cell will emit light. It is believed that the latent image problem arises after a pixel cell has been activated for a substantial amount of time because of the buildup of electrical charge on the cell walls. The built-up charge occurs because the voltage pulses applied to the pixel cell are not symmetrical with respect to time. In other words, for some of the pixel cells, a voltage pulse of one polarity (e.g., the write voltage pulse) is applied to the cell a relatively long amount of time before the opposite voltage pulse (e.g., the refresh voltage pulse) is applied. After the refresh voltage pulse, there is a relatively short amount of time before the write voltage pulse is again applied. The built-up charge on the cell wall effectively lowers the threshold voltage required to activate the pixel cell such that the write voltage pulse applied to the row electrode of the cell alone will activate the cell irrespective of the modulation voltage pulse applied to the column electrode of the cell. For other cells, the relative time durations may be reversed such that the refresh voltage pulse is applied a relatively long amount of time prior to the write voltage pulse. Thus, after the TFEL panel has been used for a substantial amount of time, the panel will become less and less useful for its intended purpose.

There have been attempted solutions for reducing or eliminating the latent image problem. For example, one solution has been to provide a symmetric drive system. In an exemplary symmetric drive system, a high voltage push-pull circuit is used to apply the write voltage pulse to the rows and the modulation voltage pulse to the columns. During one frame, the applied voltage pulses are of one polarity so that the cell voltages are applied in a first direction. In alternating frames, the polarities of the write voltage pulse and the modulation voltage pulse are reversed so that the cells are charged in the opposite direction. The alternating application of the opposite voltage pulses across the pixel cells eliminates the need for the refresh voltage pulse and has the effect of causing the voltages applied to the cells to be symmetrical in time and voltage. This technique has the disadvantage that only one light pulse is emitted per frame so that the panel only provides half the brightness. Furthermore, the electronic circuitry is more complicated because each of the high voltage electrode drivers has to drive the panel with two voltage polarities rather than just one.

SUMMARY OF THE INVENTION

The present invention includes an apparatus and a method for solving the latent image problem in thin-film electroluminescent panels while providing two light pulses per frame for each of the pixels and without requiring the use of complicated electrode drivers that must drive the electrodes with two voltage polarities.

The apparatus includes a thin-film electroluminescent display panel that has an electroluminescent phosphor layer and a plurality of row electrodes and column electrodes that define pixel cells on the display panel. The apparatus also includes a plurality of column drivers that apply column voltage pulses to the column electrodes and a plurality of row drivers that apply row voltage pulses to the row electrodes. A column driver control circuit controls the application of the column voltage pulses to the column electrodes by the column drivers. A row driver control circuit controls the application of the row voltage pulses to row electrodes by the row drivers. In the present invention, the row driver control circuit includes a first circuit that generates a plurality of refresh pulses. The refresh pulses have a first voltage polarity and are spaced apart in time by fixed time intervals. The time interval between a first refresh pulse and a second refresh pulse defines a first display frame, and the time interval between the second refresh pulse and a third refresh pulse defines a second display frame. The refresh pulses are applied to the plurality of row electrodes. The row driver control circuit also includes a second circuit that enables the row drivers to apply write voltage pulses to each of the row electrodes, one at a time. The second circuit enables the row drivers in a first sequence during the first display frame so that the row electrodes are enabled in a first order during the first display frame and enables the row drivers in a second sequence during the second display frame so that the row electrodes are enabled in a second order during the second display frame.

Preferably, the write pulses are applied to the row electrodes in order from the top of the display panel to the bottom of the display panel during the first display frame and the write pulses are applied to the row electrodes in order from the bottom of the display panel to the top of the display panel during the second display frame.

The electroluminescent display system has at least first, second and third row electrodes. The present invention includes a method of applying voltages to the row electrodes that includes the steps of applying a row voltage pulse of a first polarity (i.e., a refresh pulse) to each of the first, second and third row electrodes, and applying a row voltage pulse of a second polarity (i.e., a write pulse) in sequence to said first row electrode, then to said second row electrode, then to said third row electrode. Thereafter, the method includes the steps of again applying a row voltage pulse of said first polarity (i.e., a refresh pulse) to each of said first, second and third row electrodes, and then applying a row voltage pulse of the second polarity (i.e., a write pulse) in sequence to said third row driver, then to said second row driver, then to said first row driver. Preferably, the write pulses of the second polarity are applied to the row electrodes of the panel in order from the top of the panel to the bottom of the panel after the first refresh pulse of the first polarity and are applied to the row electrodes of the panel in reverse order from the bottom of the panel to the top of the panel after the second refresh pulse.

The alternating sequences of application of the write voltage pulses to the row electrodes cause the average residual dc voltage across each of the pixel elements of the display panel to be substantially reduced towards zero so that latent image problems caused by the residual dc voltage is substantially reduced or eliminated.

BRIEF DESCRIPTION OF THE DRAWINGS

FIG. 12 illustrates an equivalent circuit diagram for the pixel cell of FIG. 11 wherein the two dielectric insulating layers are represented by a pair of equivalent capacitors and wherein the phosphor layer is represented by a capacitor in parallel with a resistor in series with a pair of back-to-back zener diodes.

FIG. 13 illustrates a simplification of the equivalent circuit diagram of FIG. 12 wherein the pair of equivalent capacitors representing the dielectric insulating layers are represented by a single capacitor.

DETAILED DESCRIPTION OF THE PREFERRED EMBODIMENT

Figure 1:
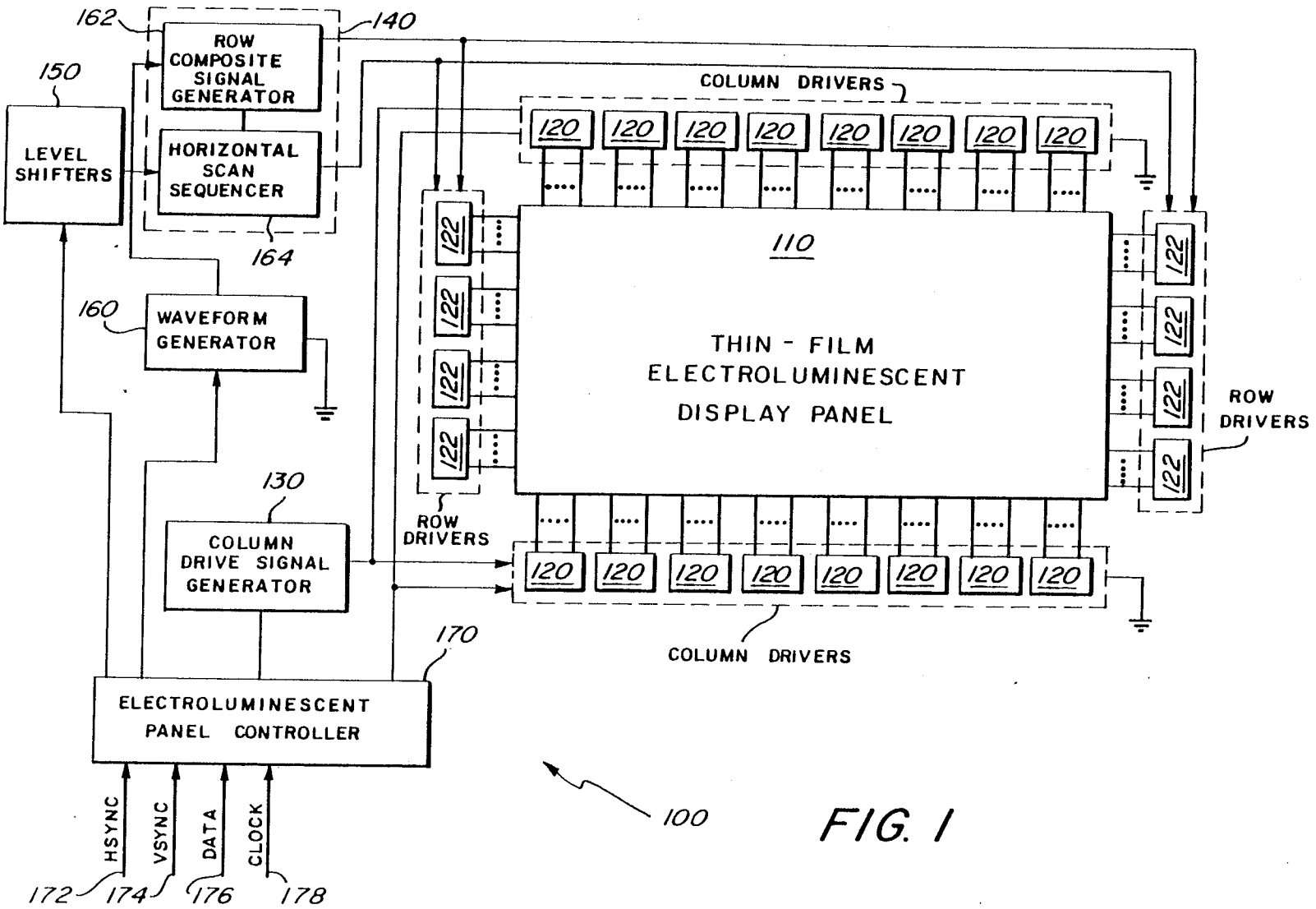
FIG. 1 illustrates a block diagram of an exemplary thin-film electroluminescent display panel and the associated circuitry for controlling the panel.

FIG. 1 illustrates a block diagram of an exemplary thin-film electroluminescent (TFEL) panel system 100. The TFEL panel system 100 includes a thin-film electroluminescent display panel 110 that will be described in additional detail below; a plurality of X-axis (column) drivers 120; a plurality of Y-axis (row) drivers 122; a column drive electronics circuit 130; a row electronics drive circuit 140; a plurality of level shifters 150; a waveform generator 160; a row composite signal generator 162; a horizontal scan sequencer 164; and an electroluminescent panel controller 170.

The electroluminescent panel controller 170 receives video input signals from a data source (not shown) and generates control signals that display images of the data on the display panel 110 via the column drive electronics circuit 130 and the row electronics drive circuit 140. For example, the electroluminescent panel controller 170 receives a horizontal synchronization signal (HSYNC) on a line 172, and receives a vertical synchronization signal (VSYNC) on a line 174 from the data source along with a data signal on a line 176 and a data clock signal on a line 178. The operation of the electroluminescent panel controller 170 with respect to the incoming synchronization, data and clock signals generally corresponds to the operation of a conventional video display monitor that displays data on a cathode ray tube (CRT). It should be understood that the vertical synchronization signal on the line 174 synchronizes the controller 170 with the beginning of each frame of data to be displayed on the display panel 110; the horizontal synchronization signal on the line 172 synchronizes the controller 170 with each horizontal line of data to be displayed on the display panel 110; and the data clock synchronizes each incoming byte of data with a corresponding pixel location on a display line.

The controller 170 is responsive to the incoming synchronization, clock and data signals and generates a plurality of control signals that cause the pixel cells of the display panel 110 to selectively emit light in accordance with the incoming data corresponding to the pixel cell.

Figure 2:
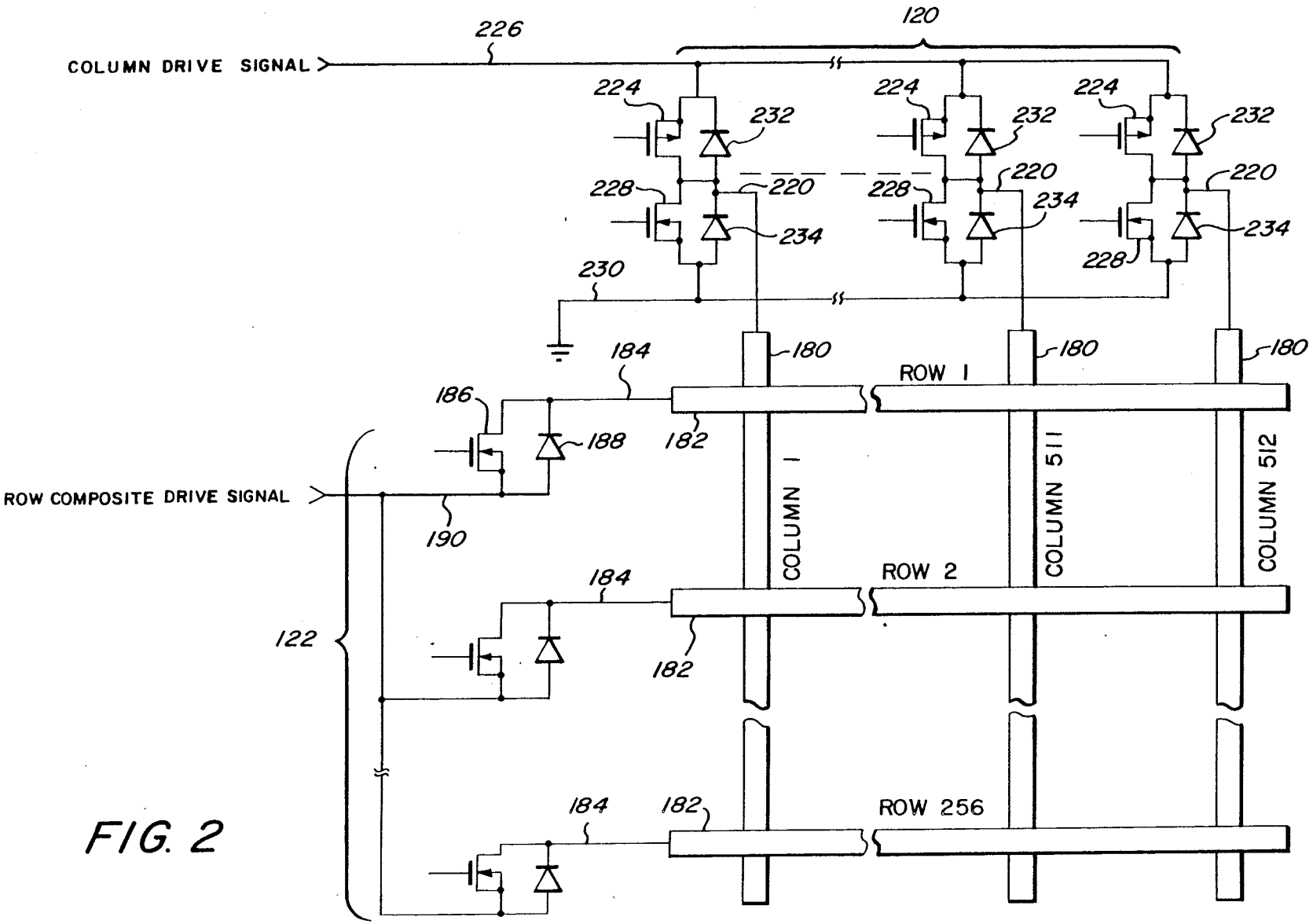
FIG. 2 illustrates a schematic representation the electrodes of the display panel of FIG. 1, showing the output portions of the column and row drivers.

FIG. 2 illustrates additional schematic details of the display panel 110, the row drivers 120, and the column drivers 122. The display panel 110 comprises a plurality of parallel X-axis (column) electrodes 180. For example, one exemplary panel 110 includes 512 column electrodes 180. The display panel further includes a plurality of parallel Y-axis row electrodes 182. For example, the exemplary panel 110 may include 256 row electrodes 182. For clarity, only a portion of three column electrodes 180 and three row electrodes 182 are illustrated in FIG. 2. The intersections of each of the row electrodes 182 with each of the column electrodes 180 defines a pixel cell. The structure of each of pixel cells will be described in more detail below.

Figure 3:
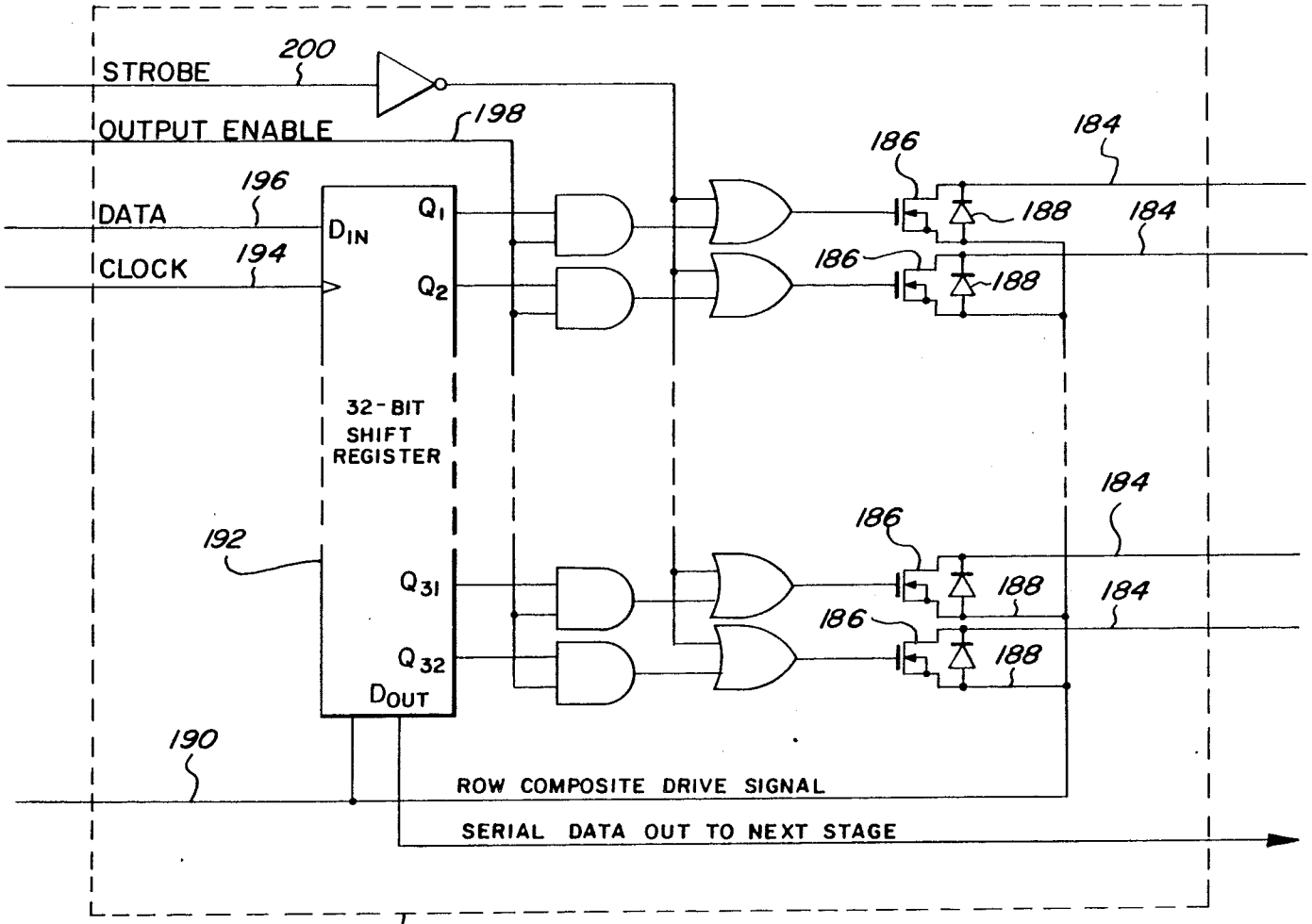
FIG. 3 illustrates a detailed logic diagram of an exemplary row driver circuit.

Each of the row electrodes 182 is electrically connected to an output line 184 from one of the Y-axis drivers 122. For example, each of the Y-axis drivers 122 advantageously comprises an HV5122 or HV5222 32 channel serial to parallel converter with open-drain outputs, available from Supertex Inc., or an equivalent, such as an SN75551 or SN75552 integrated circuit from Texas Instruments. An exemplary circuit diagram for one such integrated circuit row driver 122 is illustrated in FIG. 3. Each of the output lines 184 is connected to the drain of a MOS transistor 186 and to the cathode of a diode 188, both of which are part of the HV5122 or HV5222 integrated circuit. The source of the MOS transistor and the anode of the diode 188 are commonly connected and are connected to a line 190 that is a common voltage reference for the Y-axis drivers 122. In the embodiment described herein, the common voltage reference on the line 190 is connected to a signal shown as "ROW COMPOSITE DRIVE SIGNAL". The driver 120 further comprises a 32-bit shift register 192 having 32 outputs that drive the gates of the MOS transistors 186. The shift register 192 is clocked by a clock signal on a line 194 so that a single data bit input to the shift register 192 on a line 196 is sequentially provided as an active output from the shift register, thus enabling each of the MOS transistors 186 in sequence when an active enable (high logic level) on a line 198 and a strobe (high logic level) on a line 200 are both present. When a MOS transistor 186 is enabled, its respective output line 184 is electrically connected to the row composite drive signal on the line 190. The shift register 192 further provides a serial output signal on a line 198. The serial output of the shift register 192 in one of the row drivers 122 is selectively connected to the serial input of another shift register 192 in another row driver 122 so that a data bit is shifted from one shift register 192 in one driver into the shift register 192 in the next row driver 122. Returning briefly to FIG. 1, it can be seen that the disclosed embodiment of the present invention comprises four row drivers 122 on the left side of the display panel 110 to control 128 rows (i.e., $4\times32$) and four row drivers 122 on the right side of the display panel 110 to control 128 rows, so that a total of 256 row electrodes 182 are controlled. Preferably, the 128 rows controlled by the left-hand row drivers 122 are interleaved with the 128 rows controlled by the right-hand row drivers 122 (i.e., row 1 is controlled by a left-hand row driver 122, row 2 is controlled by a right-hand row driver 122, row 3 is controlled by a left-hand row driver 122, etc.). Typically, in previous embodiments, the sequential activation of the row electrodes 182 is accomplished by serially shifting a single active data bit through the left-hand row drivers 122 and a single active data bit through the right-hand row drivers 122. The left-hand row drivers 122 and the right-hand row drivers 122 are alternately enabled so that only one row electrode 182 is enabled at any one time. It should be understood that all eight row drivers 122 could be positioned on one side of the display panel 110 and interconnected together; however, the use of the two sets of row drivers makes it easier to interconnect the row drivers 122 and the row electrodes 182.

The row composite drive signal on the line 190 is provided as an output of the row drive electronics circuit 140. In the preferred embodiment, the row electronics circuit 140 is referenced to a floating logic ground that may be either positive or negative with respect to the ground reference of the TFEL panel system 100. Thus, the row composite drive signal is also referenced to a floating ground.

Figure 4:
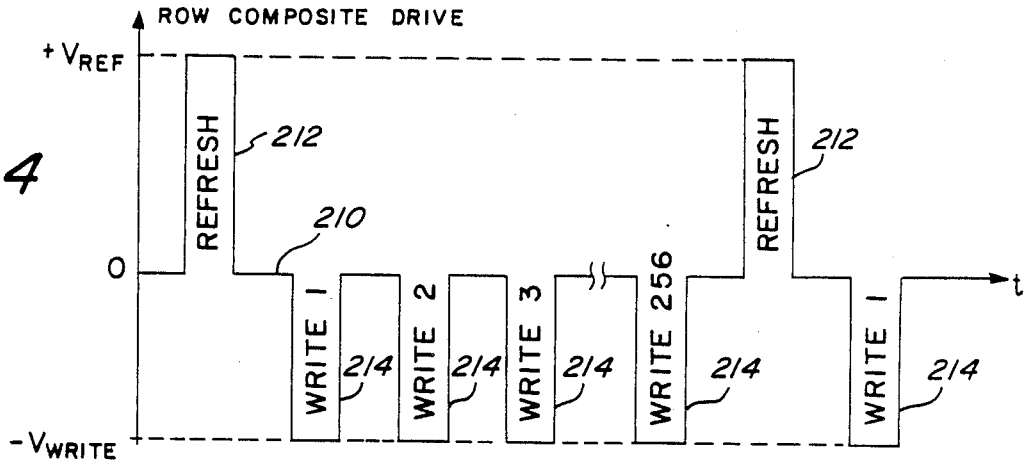
FIG. 4 illustrates an exemplary waveform representing a row composite drive signal generated by the row driver circuit of FIG. 3.

An exemplary waveform 210 for a row composite drive signal is illustrated in FIG. 4. The row composite drive signal 210 may be positive or negative with respect to a common circuit ground (shown as "0" in FIG. 4). For example, refresh pulses 212 are shown on the waveform 210 as having positive signal levels ($+V_{REF}$) which may, for example, be approximately 200 volts in one embodiment of the present invention. During each refresh pulse 212, the diodes 188 are forward biased so that current will flow from the row composite drive signal line 190 through the diodes 188 to the line 184 and thus to the row electrodes 182. In the embodiment shown, the diodes 188 are commonly connected to the row composite drive signal line 190. Thus, the refresh pulse is provided as a common drive signal to each of the row electrodes 182 at the same time. The magnitude $+V_{REF}$ of the positive going refresh pulse is selected to be sufficiently large so that it is greater than the threshold voltage of the pixel cells of the panels such that the refresh pulse will reverse the voltage across an active pixel cell (i.e., a cell that was previously activated by the most recent write pulse to its row) and cause the pixel cell to emit light. As will be explained below, an inactive pixel cell (one that has not been written since the previous refresh pulse) will not emit light during the refresh.

In contrast to the positive-going reset pulses 212, when the row composite drive signal is negative, as when a write pulse 214 is applied to one of the rows, the diodes 188 are back biased and no current flows through them. At these times, one of the transistors 186 is enabled by the active output of the shift register 192 so that the row composite drive signal on the line 190 is applied to a selected one of the row electrodes 182. As will be further discussed below, the magnitude of the negative portion of the row composite drive signal (shown as $-V_{WRITE}$) is selected to be sufficiently smaller than the threshold voltage of the pixel cells of the display panel 110 so that the row composite drive signal by itself will not cause a pixel cell to emit light. For example, in one embodiment of the present invention, each write pulse 214 has a magnitude of 140 volts (i.e., $-140$ volts with respect to the ground reference). In FIG. 4 a plurality of write pulses 214 are shown and are identified as "WRITE1", "WRITE2", "WRITE3" and "WRITE256" to indicate that the write pulses correspond to row 1, row 2, row 3, row 256, respectively, of the display panel 110. It should be understood that 256 write pulses 214 will be provided for a 256-row display panel 110.

As illustrated in FIG. 4, typically each refresh pulse is followed by a write pulse for each of the row electrodes 182. For example, if there are 256 row electrodes 182, then there will be 256 write pulses after each refresh pulse. One aspect of the present invention, to be discussed below is the timing of the refresh pulses with respect to the write pulses to avoid the generation of latent images on the display panel 110.

Figures 5, 6:
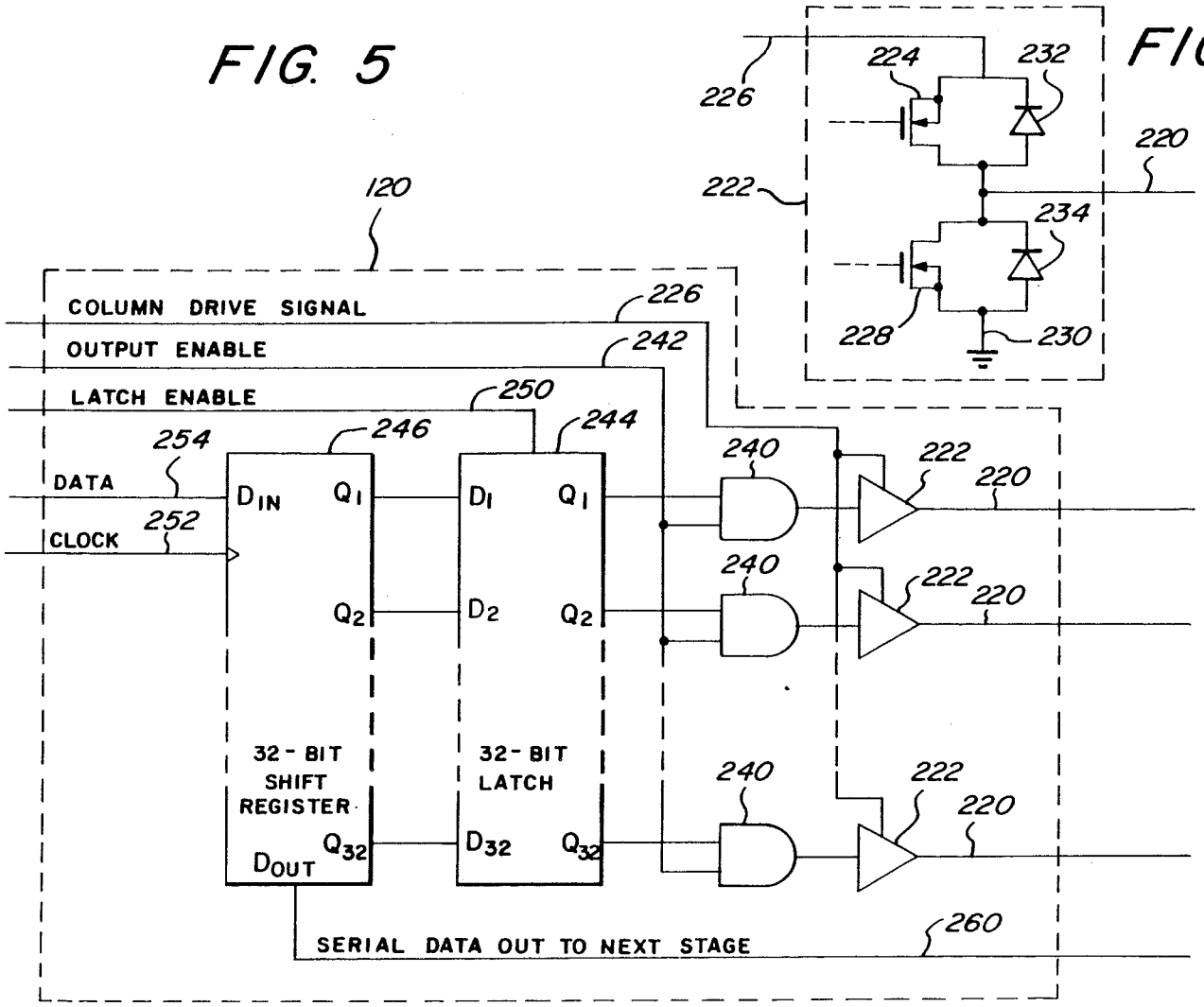
FIG. 5 illustrates a detailed logic diagram of an exemplary column driver circuit.
FIG. 6 illustrates a detailed circuit diagram of the output portion of the column driver circuit of FIG. 5.

Each of the column electrodes 180 is electrically connected to a high voltage output line 220 from one of the X-axis column drivers 120. For example, the column drivers 120 may comprise an HV5308 or HV5408 32 channel serial to parallel converter with high voltage push-pull outputs, available from Supertex Inc.; SN75553, SN75554, SN75555 and SN75556 circuits from Texas Instruments, or their equivalents. An exemplary circuit diagram for one such integrated circuit column driver 120 is illustrated in FIGS. 5 and 6. An exemplary output line 220 is connected to a push-pull output drive buffer 222 which, as illustrated in more detail in FIG. 6, comprises a MOS pull-up transistor 224 that has its drain connected to the output line 220 and has its source connected to a high voltage input signal (shown as "COLUMN DRIVE SIGNAL") on a line 226. The output drive buffer 222 further comprises a MOS pull-down transistor 228 that has its drain connected to the output line 220 and has its source connected to a low voltage reference signal (e.g., a ground reference) on a line 230. Each of the output drive buffers 222 further includes a diode 232 that has its anode connected to the output line 220 and its cathode connected to the high voltage signal line 226, and a diode 234 that has its cathode connected to the output line 220 and its anode connected to the low voltage reference 230.

Each of the output drive buffers 222 are controlled by the output of a respective AND-gate 240. One input of each AND-gate 240 is driven by an output enable signal on a line 242. A second input of each AND-gate 240 is connected to one of the thirty-two outputs of a 32-bit latch 244. The latch 244 has thirty-two inputs that are connected to the corresponding thirty-two parallel outputs of a 32-bit serial-in, parallel-out shift register 246. When a signal on a latch enable line 250 is at a first logic level, the signals on the outputs of the shift register 246 will be enabled into the latch 244, and when the signal on the latch enable line 250 is at the opposite logic level, the data in the latch 244 will be held until the signal on the latch enable line 250 switches back to the first logic level.

The 32-bit shift register 246 is driven by a clock input on a line 252 and receives serial input data on a line 254. It should be understood that the serial input data corresponds to the pixel data to be displayed on the display panel 110. For example, a logical one input on the line 254 may correspond to an active (light-emitting pixel) and a logical zero input on the line 254 may correspond to an inactive pixel. It should be further understood that the data is shifted into the shift register 246 during the time corresponding to the display of one row of data (e.g., row one) on the display panel 110. At the end of that time, the data shifted into the shift register 246 is transferred to the 32-bit latch 244 and is used to control the activity of the pixels for the next row (e.g., row two) while new data is shifted into the shift register 246 for the next row after that (e.g., row three). In the preferred embodiment, sixteen column driver circuits 120, such as the one illustrated in FIG. 5, are interconnected to control 512 columns (i.e., 16×32). Although all sixteen driver circuits could be serially interconnected, typically eight of the column driver circuits 120 are interconnected to control 256 of the column electrodes 180 from the top of the display panel 110 and eight of the column driver circuits 120 are interconnected to control the other 256 column electrodes 180 from the bottom of the display panel 110 so that the driver integrated circuits are evenly distributed along the top and bottom edges of the display panel 110. A serial output line 260 is provided to provide the serial input for the next 32-bit column driver circuit 120.

Figure 7:
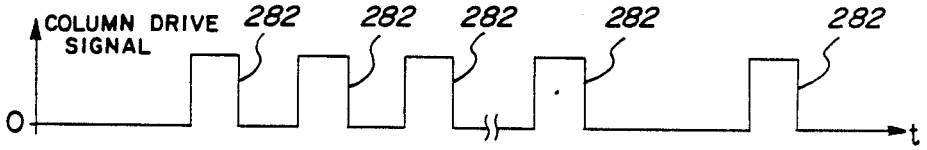
FIG. 7 illustrates an exemplary waveform representing the column drive signal applied to the input of the column driver circuit of FIG. 5.

An exemplary waveform 280 for the column drive signal on the line 226 is illustrated in FIG. 7. FIG. 7 is shown juxtaposed with FIG. 4 to illustrate the relationship between the column drive signal 280 on the line 226 and the row composite drive signal 210 on the line 190. As illustrated, the column drive signal 280 is always inactive (i.e., at ground potential or zero volts) during the time of the refresh pulses 212. Thus, the voltage between each of the row electrodes 182 and a column electrode 180 is determined by the magnitude of the refresh pulse 212. During the refresh time current will flow from the row composite drive signal line 190 through the diodes 188 (FIG. 2) through the row electrodes 182, through the column electrodes 180, through the forward-biased diodes 232 to the column drive signal line 226 that is at ground potential.

During each of the write pulses 214, the column driver signal on the line 226 has positive going pulses 282. The voltage magnitude of column drive signal pulses 282 (shown as $V_{COL}$) is selected so that when mathematically subtracted from the magnitude of the write pulses 214 (FIG. 4), the total magnitude is sufficient to cause a pixel cell to emit light. For example, in an exemplary embodiment, the magnitude of the column voltage is selected to be sixty (60) volts. Each of the output drive buffers 222 (FIG. 5) is selectively driven so either the pull-up transistor 224 or the pull-down transistor 228 is enabled. If a pixel cell defined at the intersection of a column electrode 180 and the currently addressed row electrode 182 is to emit light, the corresponding output drive buffer 222 is driven by a logical one, and the pull-up transistor 224 in that output drive buffer 222 is enabled. When the pull-up transistor 224 is enabled, the column drive signal on the line 226 is electrically connected to the output line 220 so that the corresponding column electrode 180 has a positive voltage on it (e.g., +60 volts in a preferred embodiment). Since the write pulses 214 applied to each of the row electrodes 182 have a negative voltage magnitude (e.g., −140 volts with respect to the ground reference), a pixel cell at the intersection of an active column electrode 180 and an active row electrode 182 will have a total voltage across it of $V_{COL}$-$V_{WRITE}$ (e.g., 60 *volts*−(−140 *volts*)=200 *volts*) that is sufficient to cause the pixel cell to emit light. This voltage has the opposite polarity than the previously discussed refresh voltage pulse. On the other hand, if a pixel cell is not to emit light, then the data signal applied to the output drive buffer 222 is at a logical zero and the corresponding pull-down transistor 228 is enabled. This connects the corresponding output line 220 to the ground reference so that the corresponding column electrode 180 is connected to the ground reference. Thus, the voltage between the column electrode 180 and the active row electrode 182 is insufficient to cause the pixel cell to emit light.

Figure 8:
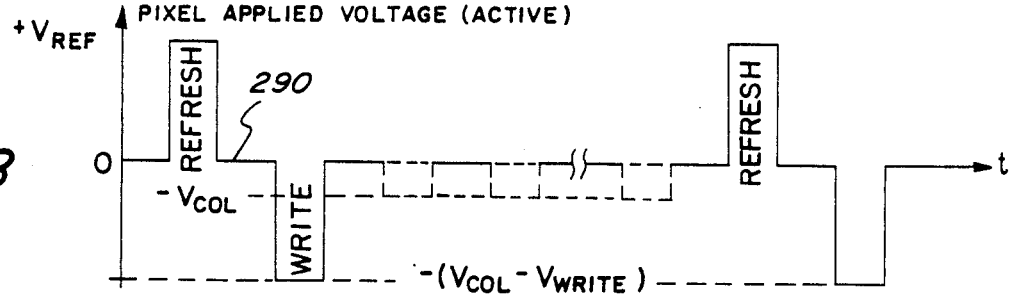
FIG. 8 illustrates an exemplary waveform representing the voltage applied across an active pixel cell.
Figure 9:
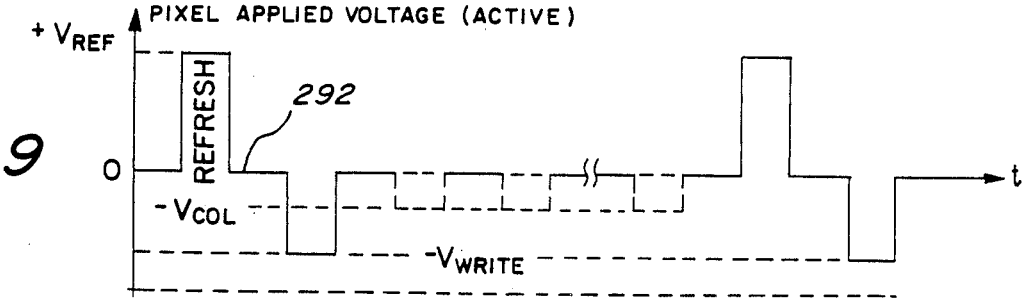
FIG. 9 illustrates an exemplary waveform representing the voltage applied across an inactive pixel cell.

The voltage across a pixel cell is referred to herein as the applied voltage. The applied voltages for two exemplary pixel cells are illustrated in FIG. 8 and in FIG. 9. FIG. 8 illustrates a voltage waveform 290 that represents the voltage applied to a pixel cell in one of the columns of row 1 that is active, and FIG. 9 illustrates a voltage waveform 292 that represents the voltage applied to a pixel cell in one of the columns of row 1 that is inactive. As illustrated in FIGS. 8 and 9, each of the two exemplary pixel cells will have a positive going pulse applied to it during the refresh time. The positive going pulse has a magnitude of $V_{REF}$ (e.g., +200 volts). During the row 1 write time, each of the pixel cells will also have a negative pulse applied to it. However, the pixel cell voltage represented in FIG. 8 has a magnitude of $V_{COL}$-$V_{WRITE}$ (e.g., 200 volts) while the pixel cell voltage represented in FIG. 9 has a magnitude of $V_{WRITE}$ only (e.g., 140 volts). Thus, as explained above, the pixel cell having the voltage waveform represented in FIG. 8 will emit light during the write time and the pixel cell having the voltage waveform represented in FIG. 9 will not emit light during the write time. As will be explained below, the pixel cell having the waveform represented in FIG. 8 will also emit light when the refresh pulse occurs because of the voltage transient, but the pixel cell having the waveform represented in FIG. 9 will not emit light during the refresh pulse. As further illustrated in FIGS. 8 and 9, the voltages applied across the pixel cells will also include smaller negative going pulses that correspond to the activation of the column electrodes 180 without the accompanying activation of the corresponding row electrode 182 for the cell. Thus, the H voltage pulses will have magnitudes of $-V_{COL}$. The smaller voltage pulses are shown in dashed lines since they are present only if the column electrode 180 is activated to write a pixel cell on another row in that same column. Otherwise the voltage applied across the pixel cell is zero volts.

Typically, the write, column and refresh voltages have been applied to an electroluminescent panel as described above. In other words, each of the row electrodes 182 of the panel 110 is sequentially activated by applying the write voltage to it, for example, beginning with row one at the top of the panel 110. At the same time, the column voltage is selectively applied to the column electrodes 180 corresponding to the pixel cells that are to be activated for the particular row electrode 182 to which the write voltage is being applied. After the write voltage has been applied to the last row in the panel 110, for example, the lowermost row, the refresh pulse is then applied to the entire panel. The pixel cells that were activated by applying the column voltage at the same time as the row voltage will again emit light when the refresh pulse is applied. Thus, each of the activated pixel cells will emit two light pulses per frame to provide additional brightness. After the refresh pulse has occurred, the panel will again be addressed beginning at the uppermost row electrode 182 and sequencing to the lowermost electrode.

It has been found that display panels 110 that are operated in the foregoing manner develop a latent image problem that increases as the panel is used. Basically, when a pixel cell has been activated (i.e., has been emitting light) for a substantial amount of time and is then deactivated, the pixel cell does not turn off entirely. Thus, although the pixel cell is not being addressed (i.e, the modulation voltage is not applied to the column electrode 180 associated with the pixel cell at the same time as the write voltage is applied to its corresponding row electrode 182), the pixel cell will emit light. Although the amount of light emitted by the unaddressed pixel cell may be less than the light emitted by an addressed pixel cell, the amount of light emitted is generally greater than the background luminescence of the panel 110. If a large number of the pixel cells have been addressed to display a constant image for a long period of time and are then unaddressed, they will continue to emit light and thus will display a latent image of the previously displayed image. Eventually, such latent images become unacceptable, and the panel 110 must be replaced by a new panel.

Figure 10:
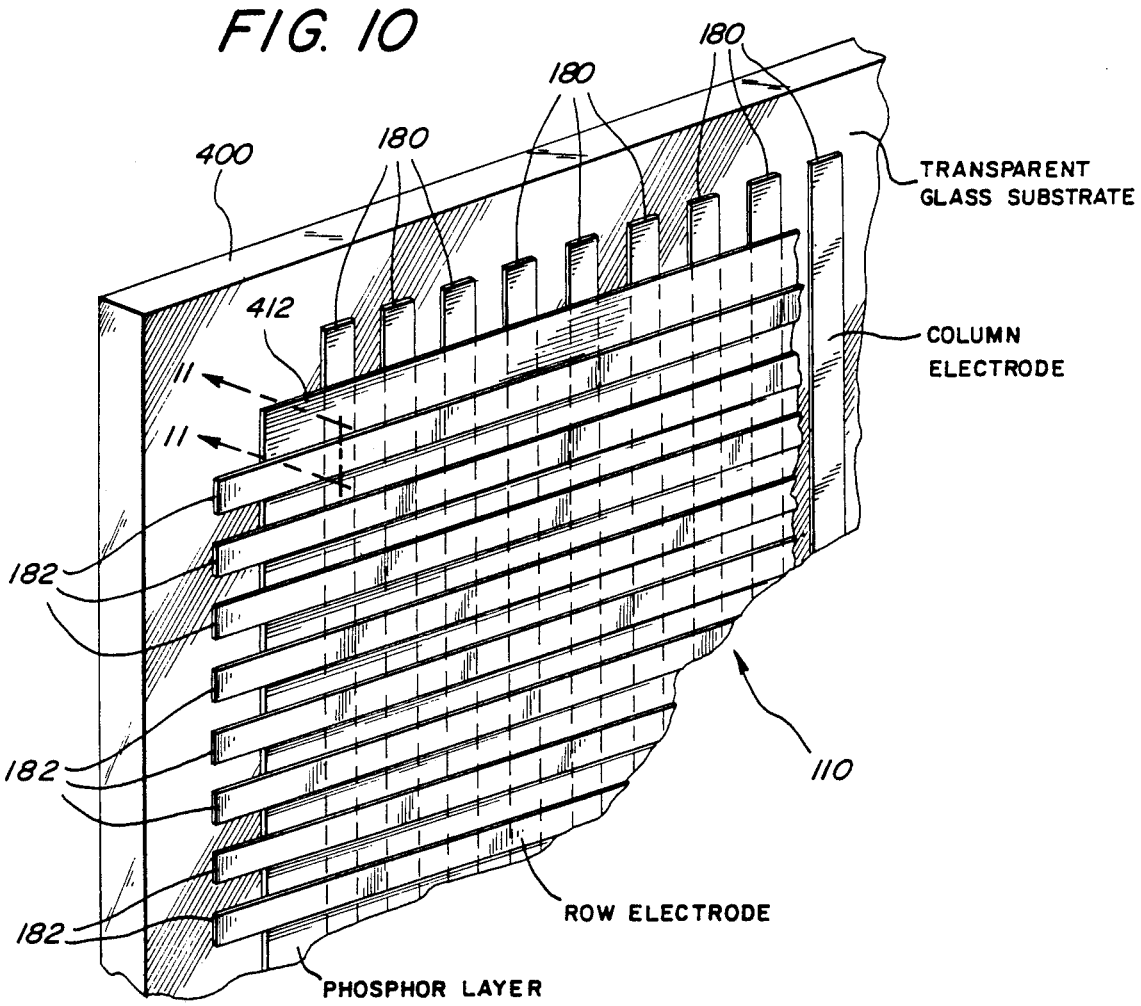
FIG. 10 illustrates a perspective view of a portion of the display panel of FIG. 1 showing the structural relationship between the row and column electrodes and the phosphor layer.
Figure 11:
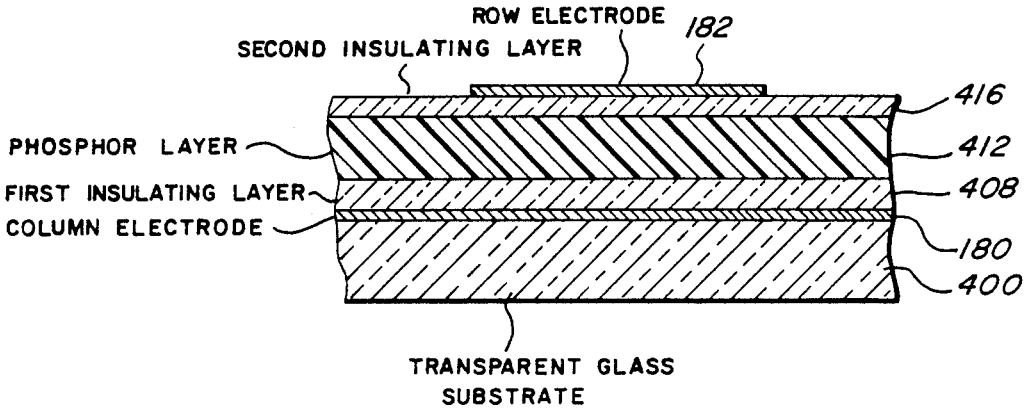
FIG. 11 illustrates a cross-sectional view of the display panel of FIG. 10 taken along the lines 11—11 in FIG. 10 showing the structural layers of an exemplary pixel cell.

In order to better understand why the latent image occurs and how the present invention substantially reduces or eliminates the latent image, it is helpful to review the physical structure of an exemplary TFEL panel 110. FIG. 10 illustrates a portion of the display panel 110 of FIG. 1 looking at the rear side of the display panel 110 (i.e., at the side opposite the normal viewing side). FIG. 11 is a cross-section of a portion of FIG. 10 taken along the lines 11—11 in FIG. 10. FIG. 11 shows the structure of an exemplary pixel cell.

As illustrated in FIGS. 10 and 11, the display panel 110 includes a transparent glass substrate 400. The plurality of vertical column electrodes 180, discussed above, are secured to the rear surface of the glass substrate 400. The vertical column electrodes 180 are constructed from an electrically conductive, transparent material, such as indium-tin oxide (ITO) which is a transition metal oxide semiconductor. A first transparent insulating layer 408 is positioned behind the vertical column electrodes 180. In exemplary embodiments of the display panel 110, the first insulating layer 408 comprises a 2000 Angstrom layer of $SiO_2$ in combination with $Si_3N_4$. An active phosphor layer 412 is positioned behind the first insulating layer 408. For example, in exemplary embodiments of the display panel 110, the phosphor layer 412 comprises a thin-film of ZnS:Mn and may advantageously be approximately 5000 Angstroms thick. A second insulating layer 416 is positioned behind the active phosphor layer 412. In exemplary embodiments, the second insulating layer 416 comprises a combination of $Al_2O_3$ and $Si_3N_4$, and may advantageously be approximately 2000 Angstroms thick. Finally, the plurality of horizontal row electrodes 182 are positioned behind the second insulating layer 416. In exemplary embodiments of the display panel 110, the horizontal row electrodes 182 comprise aluminum (Al) since it is not necessary that they be transparent. Although the connections are not shown, it should be understood that the vertical column electrodes 180 and the horizontal row electrodes 182 are electrically connected to the column drivers 120 and the row drivers 122, as was described above in connection with FIGS. 1, 2, 3 and 5.

The intersection of a horizontal row electrode 182 with one of the vertical column electrodes 180 defines a pixel cell that includes the intersecting portion of the horizontal row electrode 182, the first insulating layer 408, the active phosphor layer 412, the second insulating layer 416 and the intersecting portion of the vertical column electrode 180. An electrical circuit that is equivalent to the electrical characteristics of the structure of FIG. 11 is illustrated in FIG. 12. As illustrated in FIG. 12, the phosphor layer 412 can be represented by a capacitor $C_Z$ in parallel with the series combination of a pair of back-to-back Zener diodes $ZD_1$ and $ZD_2$ and a resistor $R_Z$. Each of the back-to-back zener diodes $ZD_1$, $ZD_2$ has a threshold voltage $V_{TH}$ so that no current flows through either zener diode until the voltage across the capacitor $C_Z$ exceeds the threshold voltage $V_{TH}$. The voltage across the capacitor $C_Z$ is referred to as the cell voltage and is shown as $V_Z$. The first and second insulating layers 408, 416 are dielectrics. Thus, the first and second insulating layers 408, 416 act as first and second capacitors $C_1$ and $C_2$, respectively, that are electrically in series with the parallel combination that represents the phosphor layer 412. The horizontal row electrode 182 acts as one plate of the capacitor $C_1$ and is also a voltage terminal for the equivalent circuit. The voltage applied to the row electrode 182 is shown as $V_Y$, and represents the row composite signal described above. The vertical column electrode 180 acts as one of the plates of the capacitor $C_2$ and is also a voltage terminal for the equivalent circuit. The voltage applied to the column electrode is shown as $V_X$ and represents the selectively enabled column voltage described above. When a sufficiently large voltage ($V_Y$-$V_X$) is applied across the horizontal row electrode 182 and the vertical column electrode 180, the active phosphor layer 412 emits a pulse of light that has a brightness that depends in part upon the characteristics of the first and second insulating dielectric layers 408, 416, the phosphor layer 412 and the voltage differential $V_Y$-$V_X$. The phosphor layer 412 in combination with the first and second insulating dielectric layers 408, 416 has ac characteristics in that a continuous application of a dc voltage to the phosphor layer does not result in a continuous emission of light.

FIG. 13 illustrates a further equivalent circuit for the exemplary pixel cell in which the two capacitors $C_1$ and $C_2$ are replaced with one capacitor $C_D$ that represents the series capacitance of the two insulating dielectric layers 408, 416. In exemplary display panels 110, the capacitors $C_1$ and $C_2$ have capacitances that are approximately equal to the capacitance of the capacitor $C_Z$. Thus, series equivalent capacitor $C_D$ has a capacitance that is approximately one-half of the capacitance $C_Z$. The voltage across the capacitor $C_D$ is referred to as the wall voltage of the pixel cell and is shown as $V_D$. In order to cause the pixel cell to emit light, the voltage applied across the pixel cell between the row electrode 182 and the column electrode 180 must be sufficiently large enough to charge the capacitor $C_D$ and the capacitor $C_Z$ so that the cell voltage $V_Z$ across the capacitor $C_Z$ is greater than the threshold voltage $V_{TH}$. When this occurs, one of the zener diodes $ZD_1$ or $ZD_2$ will conduct and electrons within the phosphor layer 212 will flow in the phosphor layer and cause the emission of light. The flow of electrons will discharge the phosphor layer capacitor $C_Z$ until the capacitor $C_Z$ is discharged to the threshold voltage $V_{TH}$ at which time current will no longer flow and the capacitor $C_Z$ will remain at the threshold voltage $V_{TH}$ until the applied voltage changes. Additional information regarding the light-generating process can be found in L. E. Tannas, Jr., "ELECTROLUMINESCENT DISPLAYS," FLAT-PANEL DISPLAYS and CRT's, Van Nostrand Reinhold Company Inc., N.Y. 1985, pp. 237–288 (ISBN: 0-442-28250-8), which is incorporated herein by reference.

As set forth above, the application of a voltage to the pixel cell is accomplished by applying a write voltage that produces a voltage less than the threshold voltage $V_{TH}$ to the row electrode 182, and, while the write voltage is applied to the row electrode 182, the column voltage is applied to the column electrodes 180 of a cell that is to emit light so that the two voltages together are greater than the threshold voltage $V_{TH}$ of the pixel cell. However, it should be understood that the capacitors $C_D$ and $C_Z$ are charged and have voltages across them that affect whether a pixel cell will emit light. As will be shown below, unless the voltages applied to a pixel cell are reversed in polarity after each emission of light, the pixel cell will not emit light again. Thus, the pixel cell must be operated in an ac mode. This will be explained below in connection with FIGS. 14–34.

Figure 14:
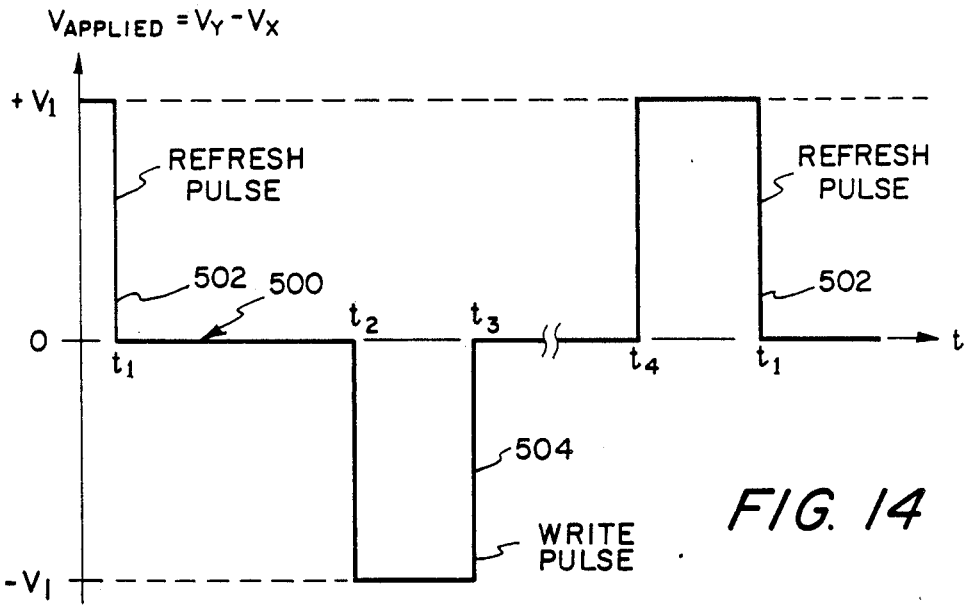
FIG. 14 illustrates an exemplary waveform of a voltage applied across the row and column electrodes of a pixel cell showing a refresh pulse having a positive voltage and a write pulse having a negative voltage.

FIG. 14 illustrates a voltage waveform 500 that represents the differential voltage $V_Y$-$V_X$ applied to the row electrodes 182 and the column electrodes 180, and which generally corresponds to the voltage waveform 290 illustrated in FIG. 8. The applied voltage is designated in FIG. 14 as $V_{APPLIED}$. As illustrated, the X voltage waveform 500 includes a positive going refresh pulse 502 that can produce a pixel cell voltage that has a magnitude greater than the threshold voltage $V_{TH}$. The maximum positive magnitude of the applied voltage $V_{APPLIED}$ is designated as $+V_1$. The waveform 500 further includes a negative going write pulse 504 that also has a magnitude sufficiently great to produce a pixel cell voltage having a magnitude greater than the threshold voltage $V_{TH}$, although of the opposite polarity to the refresh pulse. The maximum negative magnitude of the applied voltage $V_{APPLIED}$ *is designated as* $-V1$. For the purposes of the following discussion, the negative going pulses caused by the column voltage pulses for pixel cells in the same column but in different rows (illustrated in FIG. 8) will not be considered.

Figure 15:
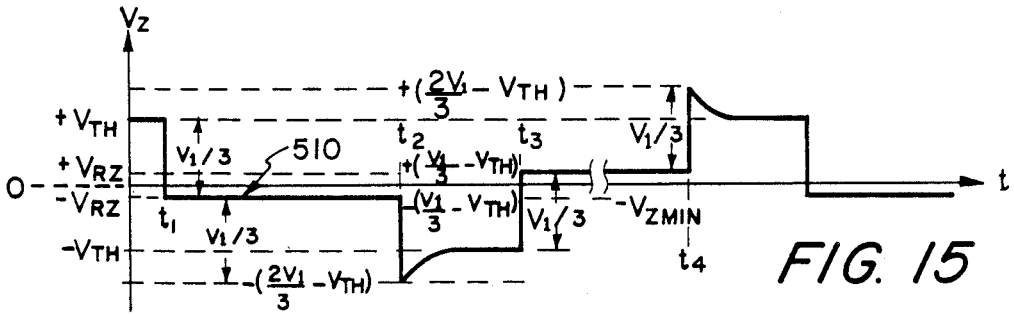
FIG. 15 illustrates an exemplary waveform that represents a voltage $V_Z$ across the phosphor layer of the pixel cell of FIG. 11 in response to the applied voltage represented by the waveform of FIG. 14.
Figure 16:
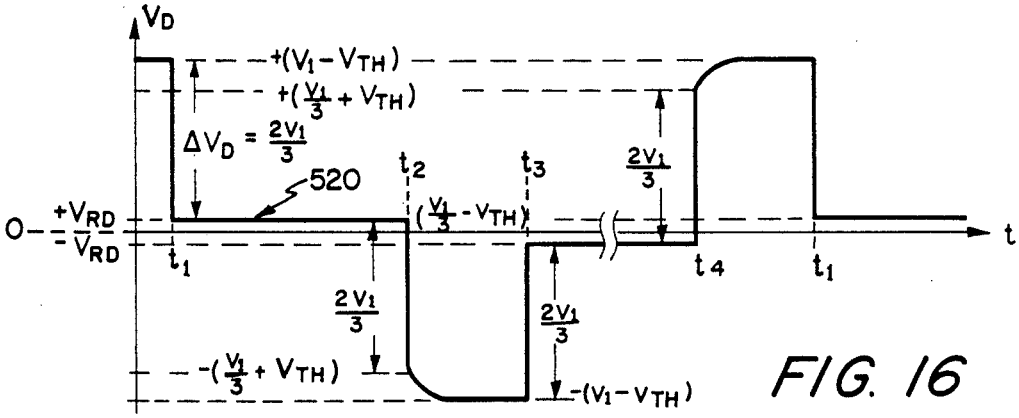
FIG. 16 illustrates an exemplary waveform that represents a voltage $V_D$ across the dielectric insulating layers equivalent capacitor $C_D$ in the equivalent circuit of FIG. 13.

FIGS. 15 and 16 illustrate exemplary voltage waveforms across the capacitor $C_D$ and the capacitor $C_Z$ responsive to the refresh pulse 502 and the write pulse 504 of FIG. 14. In FIG. 15, a voltage waveform 510 represents the voltage across the capacitor $C_Z$ and thus represents the voltage across the phosphor layer 412 of the pixel cell. In FIG. 16, a voltage waveform 520 represents the voltage across the capacitor $C_D$ and thus represents the total voltage across the first and second insulating dielectric layers 408, 416. Starting at the left portion of the waveforms 500 (FIG. 14), 510 (FIG. 15), and 520 (FIG. 16), the three waveforms represent the applied voltage $V_{APPLIED}$, the cell voltage $V_Z$, and the cell wall voltage $V_D$ towards the end of a refresh pulse. In other words, the pixel cell has already emitted a light pulse and the cell capacitor $C_Z$ has discharged to the threshold voltage $+V_Z$. Since the applied voltage $V_{APPLIED}$ is still at its positive maximum voltage $V_1$, the voltage across the capacitor $C_D$ is therefore equal to the difference between the applied voltage and the cell voltage, i.e.,:

$$V_D = +V_{DMAX} = V_{APPLIED} - V_Z = V_1 - V_{TH} \quad (1)$$

Figure 17:
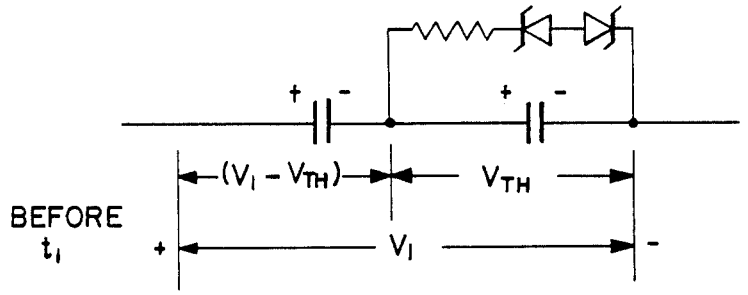
FIG. 17 illustrates the equivalent circuit of FIG. 13 showing the voltages across the equivalent capacitors when the refresh pulse has been applied to the pixel cell for a sufficiently long time so that the capacitor representing the phosphor layer has discharged to the threshold voltage of the pixel cell.

Thus, the capacitors of the equivalent circuit of FIG. 13 will be charged to the voltages as illustrated in FIG. 17.

The end of the refresh pulse occurs at a time $t_1$. At this time, the applied voltage drops from $+V_1$ to zero volts. This drop in the applied voltage results in a redistribution of the charges stored by the capacitors $C_Z$ and $C_D$. For purposes of this portion of the discussion, it has been assumed that the equivalent capacitance $C_D$ is approximately one-half the equivalent capacitance $C_Z$. If the two capacitors $C_D$ and $C_Z$ were simply series connected, the charge stored in them would be substantially equal and the capacitors would have voltages across them that are inversely proportional to the capacitance (i.e., $q_D = q_Z = C_D V_D = C_Z V_Z$, where $q_D$ and $q_Z$ are the respective charges across the two capacitors). Thus, both capacitors would discharge when the applied voltage went to zero. However, the circuit in parallel to the capacitor $C_Z$ has the effect of limiting the steady-state voltage across the capacitor $C_Z$ to the threshold voltage $V_{TH}$. The magnitude of the applied voltage is selected to be greater than three times the threshold voltage (i.e., $V_1 > 3 \times V_{TH}$). Therefore, since the applied voltage is equal to the sum of the voltage VD and the voltage $V_Z$, the voltage $V_D$ across the capacitor $C_D$ will be more than twice the voltage $V_{TH}$ across the capacitor $C_Z$. Since the capacitance $C_Z$ is assumed to be approximately twice the capacitance $C_D$, the charge ($q_D = C_D \times V_D$) stored in the capacitor $C_D$ will be greater than the charge ($q_Z = C_Z \times V_Z$) stored in the capacitor $C_Z$. Thus, when the applied voltage drops to zero, the charges will be redistributed so that the two capacitors will be equally charged. The redistribution of the charges results in a small residual negative voltage $V_{RZ}$ across the capacitor $C_Z$ and a small residual positive voltage $V_{RD}$ across the capacitor $C_D$, as illustrated between the time $t_1$ and a time $t_2$ in FIG. 15 and 16, respectively. In order to have a zero loop voltage when the applied voltage is zero, the voltage $V_{RD}$ is substantially equal to the voltage $V_{RZ}$. Since the residual voltage is caused by the imbalance in the charges ($\Delta q$) across the capacitors, the magnitudes of the residual voltages can be determined by dividing the charge imbalance by the total capacitance as follows:

$$\Delta q = C_D V_D - C_Z V_Z = C_D(V_1 - V_{TH}) - C_Z V_{TH} \quad (2)$$

$$V_{RZ} = -V_{RD} = \Delta q/(C_D + C_Z) = [C_D(V_1 - V_{TH}) - C_Z V_{TH}]/(C_D + C_Z) \quad (3)$$

In a particular example, where $C_Z$ is approximately twice $C_D$ (i.e., $C_Z = 2C_D$), equation (3) reduces to:

$$V_{RZ} = -V_{RD} = C_D(V_1 - 3V_{TH})/1.5C_D = -(V_1/3 - V_{TH}) \quad (4)$$

The following discussion assumes that $C_Z = 2C_D$. However, it should be understood that other exemplary display panels can have other capacitance ratios, and the assumed ratio used herein is by way of example only.

Figure 18:
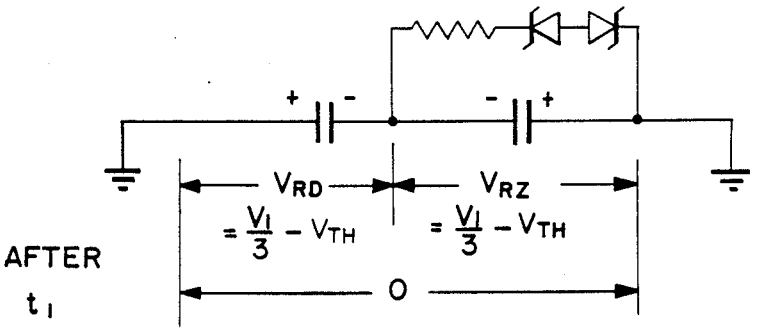
FIG. 18 illustrates the equivalent circuit of FIG. 13 showing the voltages across the equivalent capacitors when the refresh pulse terminates and the charge on the equivalent capacitors redistributes to provide residual voltages across the capacitors.

The residual charges and corresponding residual voltages remain until the write pulse begins at the time $t_2$. Thus, the equivalent circuit of FIG. 13 will be charged as illustrated in FIG. 18. It can be seen from the foregoing that the change in the applied voltage (i.e., $\Delta V_{APPLIED} = (V_1 - 0)$) is applied across the two equivalent capacitors in inverse proportion to the capacitances. In other words, the change in the voltage across the capacitor $C_D$ ($\Delta V_D$) at the time $t_1$ is:

$$\Delta V_D = (V_1 - V_{TH}) - (V_1/3 - V_{TH}) = 2V_1/3 \quad (5)$$

Similarly, the change in the voltage across the capacitor $C_Z$ ($\Delta V_Z$) at the time $t_1$ is:

$$\Delta V_Z = V_{TH} - (-(V_1/\mathbf{b} - V_{TH})) = V_1/3 \quad (6)$$

Figure 19:
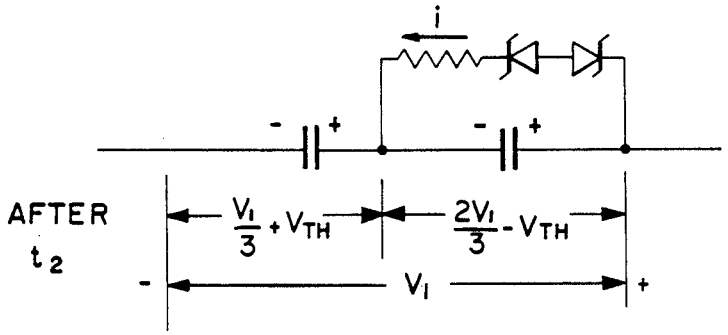
FIG. 19 illustrates the equivalent circuit of FIG. 13 when a write pulse is first applied to the pixel cell and the voltage across the phosphor layer equivalent capacitor $C_Z$ increases to a magnitude greater than the threshold voltage of the pixel cell so that current flows through the equivalent resistor and causes the emission of light.
Figure 20:
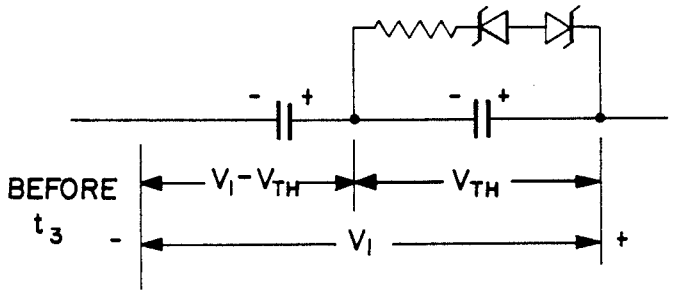
FIG. 20 illustrates the equivalent circuit of FIG. 13 while the write pulse is still applied to the pixel cell, but after the equivalent capacitor $C_Z$ has discharged to the threshold voltage.

At the time $t_2$, a write pulse in combination with a column signal causes the applied voltage to switch to a negative magnitude of $V_1$ (i.e., it switches to $-V_1$) and the equivalent circuit after the time $t_2$ appears as in FIG. 19. The applied voltage causes current to flow to charge the two equivalent capacitors $C_D$ and $C_Z$ to charge the capacitors in the opposite direction as they were charged during the refresh pulse. Since the charging current through the two capacitors is the same, the change in the voltages across the two capacitors will once again be inversely proportional to the capacitances and will be substantially equal to the change in the applied voltage. In other words, again assuming that $C_Z$ is approximately equal to twice $C_D$, the voltage across the capacitor $C_D$ will change by an amount $2V_1/3$ and the voltage across the capacitor $C_Z$ will change by an amount $V_1/3$. Thus, the voltage across the capacitor $C_D$ will change from ($V_1/3 - V_{TH}$) to $-(V_1/3+V_{TH})$. Similarly, the voltage across the capacitor $C_Z$ will change from $-(V_1/3-V_{TH})$ to $-(2V_1/3-V_{TH})$. Since $V_1$ is more than three times greater than $V_{TH}$, the new voltage across $C_Z$ will be greater than $V_{TH}$. Therefore, current will flow through the resistor $R_2$ and cause the pixel cell to emit light. The flow of current (indicated by i in FIG. 19) will discharge the capacitor $C_Z$ until the voltage across the capacitor $C_Z$ is substantially equal to the threshold voltage $V_{TH}$ as shown at $t_3$ in FIG. 15. At the same time, the voltage across the capacitor $C_D$ will increase so that it is substantially equal to $-(V_1-V_{TH})$. Thus, the circuit will reach a steady-state condition as illustrated in FIG. 20.

Figure 21:
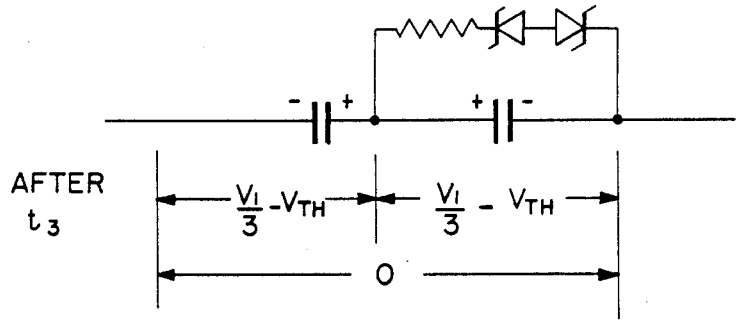
FIG. 21 illustrates the equivalent circuit of FIG. 13 when the write pulse is terminated and the charge on the equivalent capacitors is redistributed to provide residual voltages across the equivalent capacitors.
Figure 22:
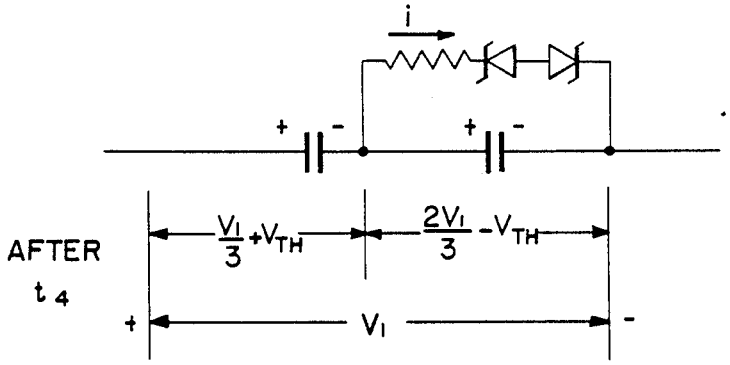
FIG. 22 illustrates the equivalent circuit of FIG. 13 when the refresh pulse is first applied to the pixel cell and the voltage across the phosphor layer equivalent capacitor $C_Z$ increases to a magnitude greater than the threshold voltage of the pixel cell so that current flows through the equivalent resistor and causes the emission of light.

The voltages $V_Z$ and $V_C$ will remain substantially at the levels $-V_{TH}$ and $-(V_1-V_{TH})$ until a time $t_3$ when the applied voltage $V_{APPLIED}$ switches from $-V_1$ to zero volts. At the time $t_3$, the foregoing analysis for the time $t_1$ can be applied again for the opposite polarity. Thus, it can be seen that the voltage $V_Z$ will switch to a small positive residual positive voltage $+V_{RZ}$ that has a magnitude of $+(V_1/3-V_{TH})$. Similarly, the voltage $V_D$ will switch to a small residual negative voltage $-V_{RD}$ that has a magnitude of $-(V_1/3V_{TH})$. The condition of the circuit after the time $t_3$ is illustrated in FIG. 21. The two capacitors will retain these voltages until a time $t_4$, when the applied voltage switches from zero volts to $+V_1$ to provide a second refresh pulse 502.

At the time $t_4$, the analysis for the time $t_2$ applies for a positive going transition. Thus, the voltage $V_Z$ across the capacitor $C_Z$ initially increases to $+(2V_1/3-V_{TH})$ while the voltage across the capacitor $C_D$ initially increases to $+(V_1/3+V_{TH})$ as illustrated by the equivalent circuit in FIG. 22. After reaching the voltage $+(2V_1-V_{TH})$, current will flow through the pixel cell, as indicated by the arrow i, and the cell will emit light. The flow of current causes the capacitor $C_Z$ to discharge to $+V_{TH}$ where it remains until the time $t_1$ at the end of the refresh pulse 502. Similarly, the voltage $V_D$ across the capacitor $C_D$ increases to $+(V_1-V_{TH})$ as the capacitor $C_Z$ discharges. Thus, at the end of the refresh pulse 502, at the time $t_1$, the two capacitor voltages will be at the same magnitudes as they were at the beginning of this discussion and as illustrated in FIG. 17.

Figure 23:
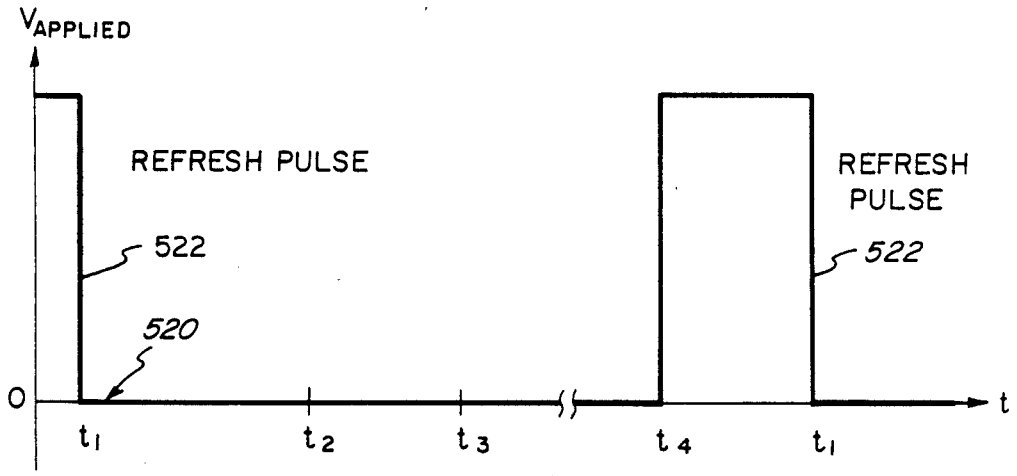
FIG. 23 illustrates an exemplary voltage waveform that represents the voltage applied to a pixel cell when refresh pulses are applied to a pixel cell without any write pulses.
Figure 24:
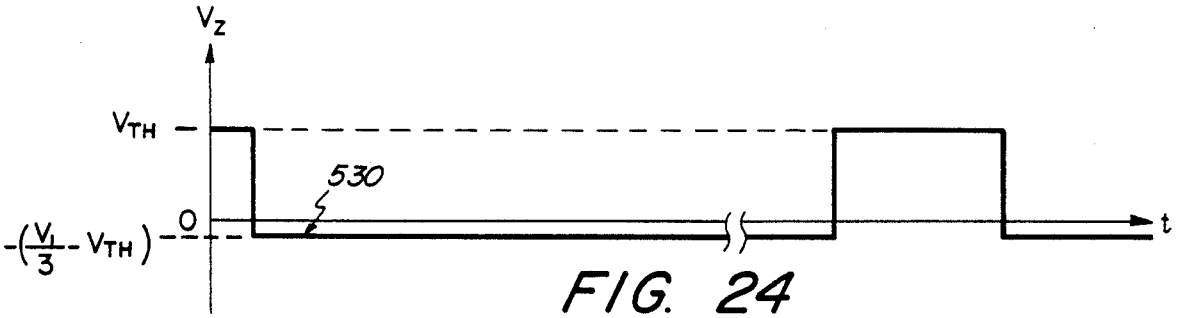
FIG. 24 illustrates an exemplary voltage waveform that represents the voltage across the phosphor layer equivalent capacitor $C_Z$ of the phosphor layer of the pixel cell when the voltage waveform of FIG. 23 is applied to the pixel cell.
Figure 25:
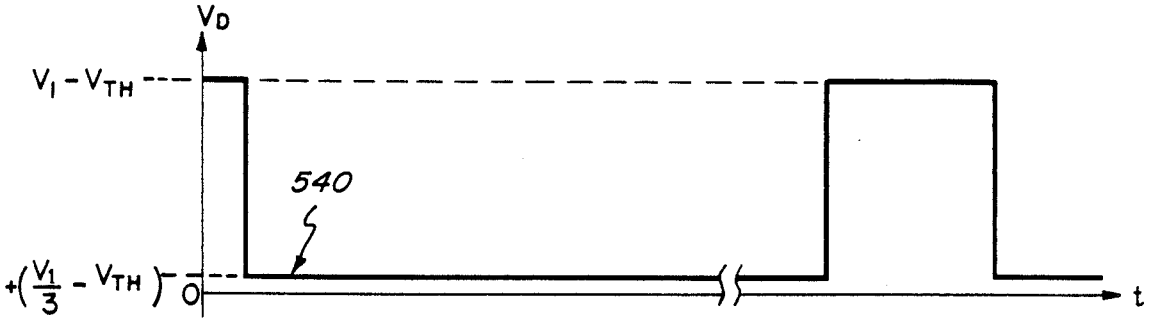
FIG. 25 illustrates an exemplary voltage waveform that represents the voltage across the dielectric insulating layers equivalent capacitor $C_D$ when the voltage waveform of FIG. 23 is applied to the pixel cell.

FIGS. 23–25 illustrate the voltage waveforms that occur when only a refresh pulse is provided to a pixel cell. A voltage waveform 520 represents the applied voltage that only has a pair of refresh pulses 522 that occur between a time $t_4$ and a time $t_1$, as before. Unlike the voltage waveform 500 of FIG. 14, no write pulses occur between the times $t_2$ and $t_3$. The waveform 530 in FIG. 24 represents the voltage across the capacitor $C_Z$ and a waveform 540 in FIG. 25 represents the voltage across the capacitor $C_D$. The voltages before and after the time $t_1$ are similar to the ones previously described. However, since there is no write pulse at the time $t_2$, there is no voltage change at the time $t_2$. Thus, the voltage across the two capacitors remain the same from after the time $t_1$ until the time $t_4$. At the time $t_4$, the applied voltage again switches to $+V_1$ and the voltage change is applied across the two capacitors $C_Z$ and $C_D$ inversely proportional to the capacitances. In other words, the voltage across the capacitor $C_Z$ will change by $V_1/3$ and the voltage across the capacitor $C_D$ will change by $2V_1/3$. However, as illustrated in FIG. 24, the voltage across the capacitor $C_Z$ is initially $-(V_1/3-V_{TH})$. Thus, the voltage across the capacitor $C_Z$ will only increase to approximately $+V_{TH}$. Thus, since the voltage across the capacitor $C_Z$ is substantially equal to the threshold voltage, no current will flow in the pixel cell and the pixel cell will not emit light. It can therefore be seen that the application of an ac applied voltage is necessary to cause a pixel cell to emit light. Furthermore, since the pixel cell does not emit light, the residual voltage across the pixel cell does not contribute to the latent image effect.

Figure 26:
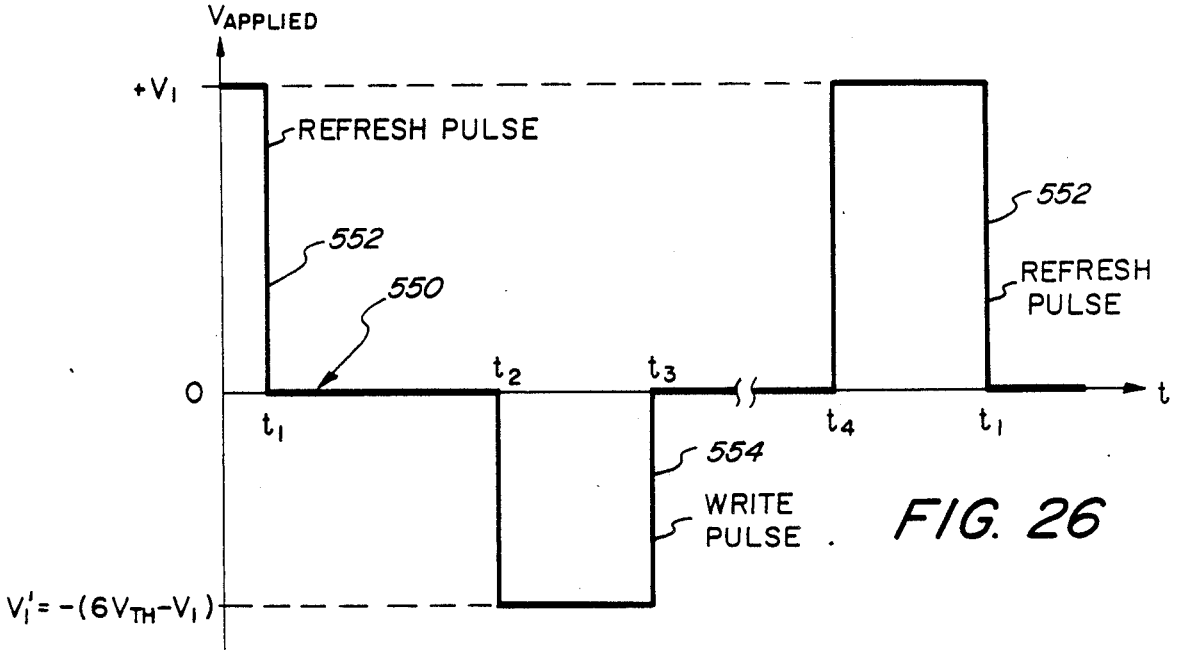
FIG. 26 illustrates an exemplary voltage waveform that represents the voltage applied to a pixel cell by a refresh pulse followed by a row write pulse without a corresponding column write pulse so that the voltage applied to the pixel cell is of insufficient magnitude to cause the pixel cell to emit light.
Figure 27:
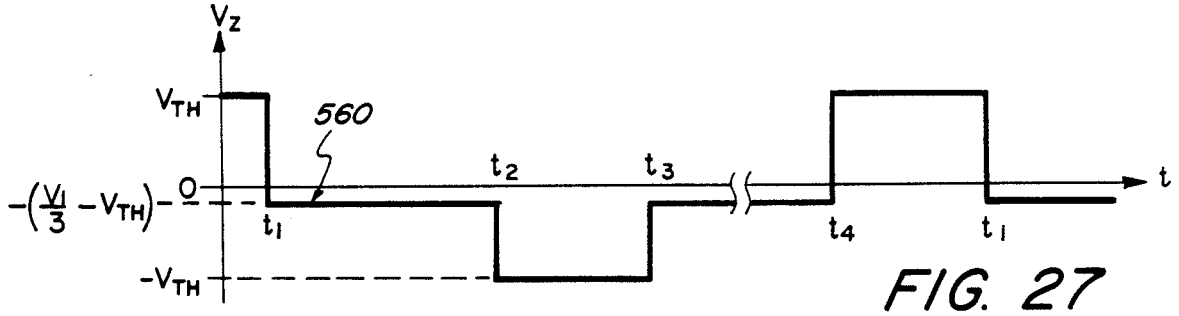
FIG. 27 illustrates an exemplary voltage waveform that represents the voltage across the phosphor layer equivalent capacitor $C_Z$ in response to the applied voltage waveform of FIG. 26.
Figure 28:
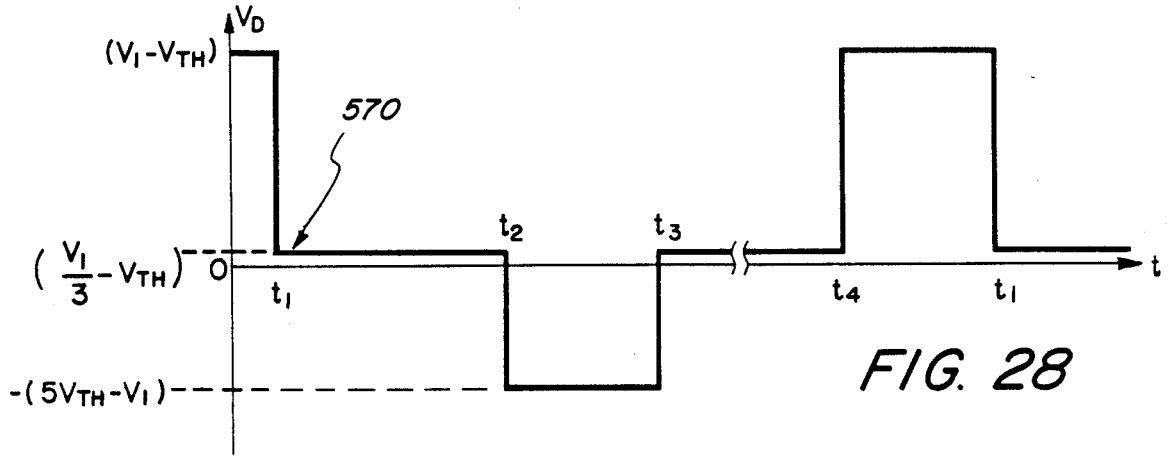
FIG. 28 illustrates an exemplary voltage waveform that represents the voltage across the dielectric insulating layers equivalent capacitor $C_D$ in response to the applied voltage waveform of FIG. 26.

FIGS. 26–28 illustrate the effect of a write pulse without a corresponding column pulse. A waveform 550 in FIG. 26 illustrates the applied voltage with a pair of refresh pulses 552 that begin at times $t_4$ and end at times $t_1$. A write pulse 554 occurs between times $t_2$ and $t_3$. However, unlike the write pulse 504 in FIG. 14, the write pulse 554 in FIG. 26 comprises only the row composite voltage and does not include the additional voltage provided by the column drive signal. Thus, in the embodiment described herein, the pulse 554 has a negative amplitude, shown as $-V_1'$ in FIG. 26, that has a magnitude that is less than or equal to $6V_{TH}-V_1$ (i.e., $V_1' \leqq (6V_{TH}-V_1)$). For example, in an exemplary embodiment of a display panel, the voltage $V_1$ is approximately 200 volts and the threshold voltage is approximately 57 volts. In such an embodiment, the voltage $V_1'$ is selected to be less than 142 volts, for example, 140 volts.

FIG. 27 illustrates a voltage waveform 560 that represents the voltage across the capacitor $C_Z$, and FIG. 28 illustrates a voltage waveform 570 that represents the voltage across the capacitor $C_D$. When the applied voltage switches from $+V_1$ to zero at the time $t_1$, the voltages across the two capacitors change to the residual voltages $-V_{RZ}$ and $+V_{RD}$, as was illustrated in FIGS. 15 and 16. At the time $t_2$, the write pulse 554 (FIG. 26) occurs. The change in voltage ($V_1'=6V_{TH}-V_1$) is applied across the two capacitors; however, as seen by the following calculations, the change in voltage is insufficient to cause the voltage across the capacitor $C_Z$ to exceed the threshold voltage:

$$\begin{aligned} V_Z(t_2) &= -(V_1/3 - V_{TH}) - (V'_1/3) \\ &= -(V_1/3 - V_{TH}) - ((6V_{TH} - V_1)/3) \\ &= -V_{TH} \end{aligned} \tag{7}$$

As set forth above, in an exemplary embodiment, the magnitude $V_1'$ of the applied voltage is selected to be less than or equal to six times the threshold voltage $V_{TH}$ minus $V_1$ (the magnitude of the threshold voltage). In such an embodiment, Equation (7) indicates that when the magnitude $V_1'$ is equal to the $6V_{TH}-V_1$, the voltage across the capacitor $C_Z$ is equal to the threshold voltage and is therefore insufficient to cause current to flow through the pixel cell. Thus, no light will be emitted by the pixel cell. The voltage $V_D$ across the capacitor $C_D$ will change to:

$$-(2V_1'/3-(V_1/3-V_{TH}))=V_1-5V_{TH}=-(5V_{TH}-V_1) \quad (8)$$

Since no current flows through the equivalent resistor $R_Z$ of the pixel cell, the voltages across the two capacitors will remain substantially constant until the time $t_3$ at which time the applied voltage switches back to zero volts. Since the same voltage transition occurs with the opposite polarity, the voltages across the two capacitors will switch back to substantially the same voltages as they had prior to the time $t_2$. Thus, the voltages are substantially the same as if the write pulse 554 had never occurred. Thus, when the refresh pulse 552 occurs at the time $t_4$, the voltage transitions across the capacitors $C_Z$ and $C_D$ in FIGS. 27 and 28, respectively, will be substantially the same as the voltage transitions at the time $t_4$ in FIGS. 24 and 25, respectively. Thus, the voltage across the capacitor $C_Z$ will increase only to $+V_{TH}$ which is insufficient to cause current to flow and cause emission of light. Thus, it can be seen that unless a write pulse of sufficiently large voltage has occurred between refresh pulses, neither the write pulse nor the refresh pulses will cause the emission of light. Furthermore, since there is no emission of light, there is no contribution to the latent image problem.

The foregoing discussion of the operation of a pixel cell during the refresh and write pulses is generally well-known. Numerous panels have been constructed to utilize the above-described operation to provide selective control of the emission of light from pixel cells by alternately applying write pulses and refresh pulses to each of the pixel cells. As set forth above, typically, one refresh pulse is applied to the entire panel 110 and then the write pulses have been applied sequentially to each row electrode 182 from the top row of the panel 110 to the bottom row of the panel 110. However, as briefly discussed above, it has been found that applying a single refresh pulse at a fixed time with respect to the write pulses causes a problem with latent images on the display panel 110, particularly with respect to the uppermost and lowermost rows of the display panel 110. The latent image problem is believed to be caused by a shift in the threshold voltage of the affected pixel cells such that the magnitude of the voltages of the row write pulses exceed the shifted threshold voltage. Thus, although a column pulse is not applied to the column electrode 180 of a pixel cell, the pixel cell will emit a low-level light pulse each time its row electrode 182 is activated.

Figure 29:
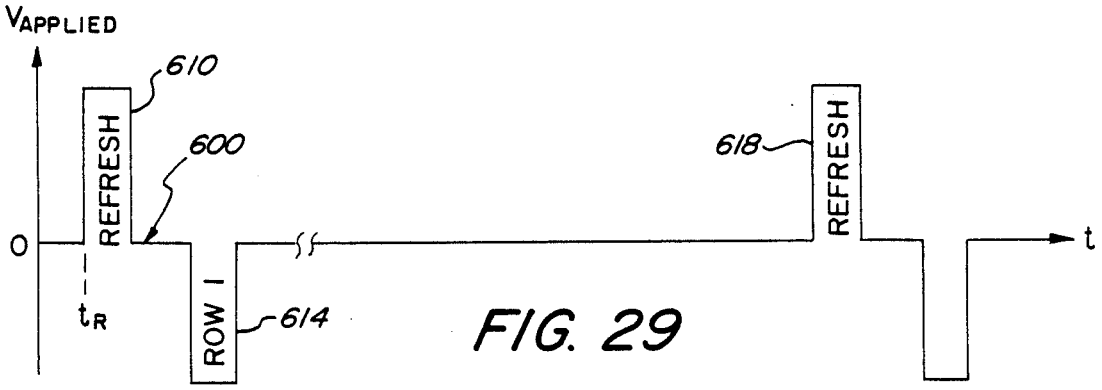
FIG. 29 illustrates an exemplary voltage waveform that represents the voltage applied to an exemplary pixel cell in row 1 of the display panel.
Figure 30:
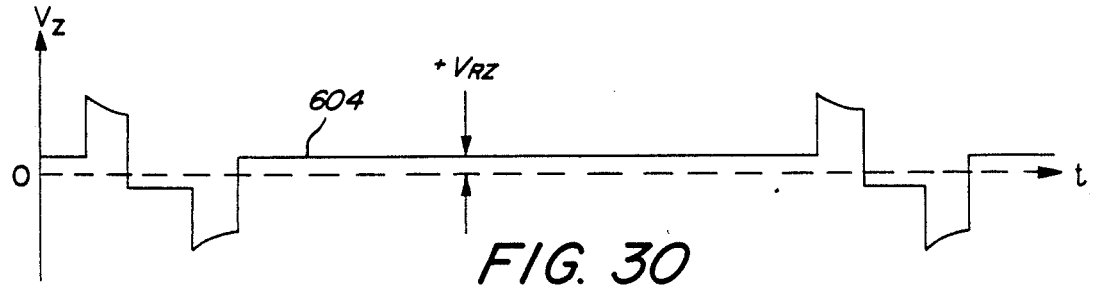
FIG. 30 illustrates an exemplary voltage waveform that represents the voltage across the phosphor layer of the exemplary pixel cell in row 1 in response to the voltage waveform of FIG. 29.

It is further believed that the shift in the threshold voltage is caused by the long-term asymmetrical application of refresh pulses and write pulses to a pixel cell. This is illustrated in FIGS. 29–34 for pixel cells in three different rows of an exemplary display panel 110. FIGS. 29 and 30 illustrate an applied voltage waveform 600 and a cell voltage waveform 604 for a pixel cell in the uppermost row (i.e., row 1) of the display panel. As illustrated, the refresh pulse 610 occurs at a time $t_R$ and, shortly afterward, a write pulse 614 occurs for the first row. Thereafter, the remaining rows are of the panel are activated before another refresh pulse 618 occurs. It can be seen that the residual cell voltage $V_{RZ}$ across the pixel cell after the write pulse 614 is concluded is positive and remains positive for substantially all the time required to access the other 255 rows of the display panel 110. This results in an average positive dc voltage across the pixel cell during the time required to access all the rows of the display panel 110. Although no light-producing current is flowing through the pixel cell while this low-level average dc voltage is present, it is believed that the average dc voltage causes the migration and trapping of charges within the pixel cell that result in the lowering of the threshold voltage $V_{TH}$. The longer that a pixel cell is continuously addressed and thus maintained in this asymmetrical condition, the more pronounced the lowering of the threshold voltage becomes and the more intense will be the light that is emitted by the pixel cell after it is no longer addressed.

Figure 31:
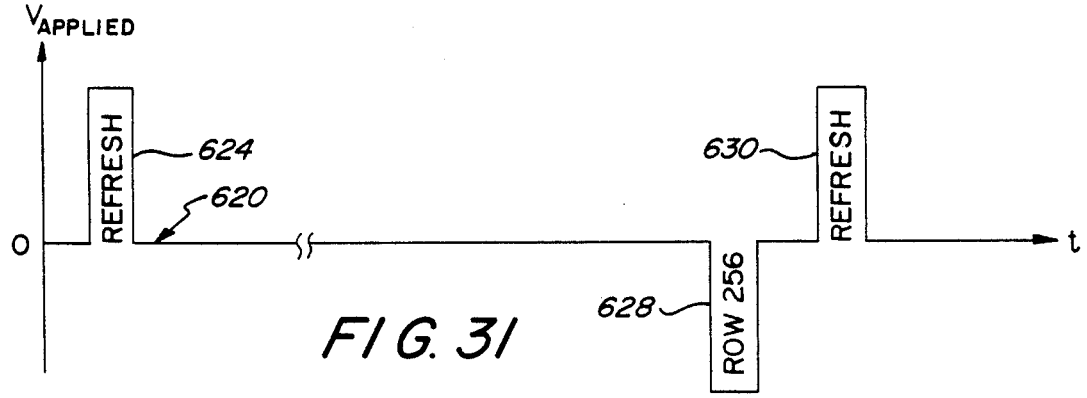
FIG. 31 illustrates an exemplary voltage waveform that represents the voltage applied to an exemplary pixel cell in row 256 of the display panel.
Figure 32:
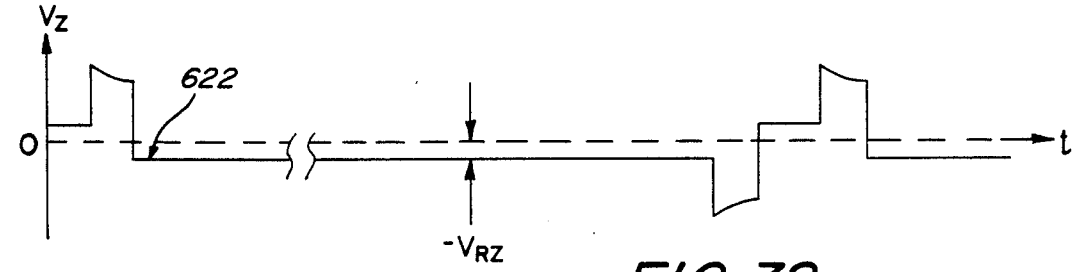
FIG. 32 illustrates an exemplary voltage waveform that represents the voltage across the phosphor layer of an exemplary pixel cell in row 256 in response to the voltage waveform of FIG. 31.

A similar effect occurs with an addressed pixel cell in the lowermost row (i.e., row 256) of the panel 110. This effect is illustrated in FIGS. 31 and 32. In FIG. 31, a voltage waveform 620 represents the voltage applied to the pixel cell with respect to time, and, in FIG. 32, a voltage waveform 622 represents the voltage $V_Z$ across the pixel cell. As illustrated in FIGS. 31 and 32, a first refresh pulse 624 occurs at the time $t_r$ as before. However, a first write pulse 628 does not occur until shortly before a second refresh pulse 630. Thus, there is a long period of time after the first refresh pulse 624 before the first write pulse 628 occurs. During the time between the end of the first refresh pulse 624 and the beginning of the first write pulse 628 (i.e., during the time that rows 1–255 of the display panel are being accessed), the voltage across the addressed pixel cell in the lowermost row will have a residual negative voltage $-V_{RZ}$. This long-term negative voltage results in an average negative dc voltage across the pixel cell. Again, it is believed that the negative average dc voltage across the pixel cell causes the migration and trapping of charges that results in the lowering of the threshold voltage of the pixel cell.

Figure 33:
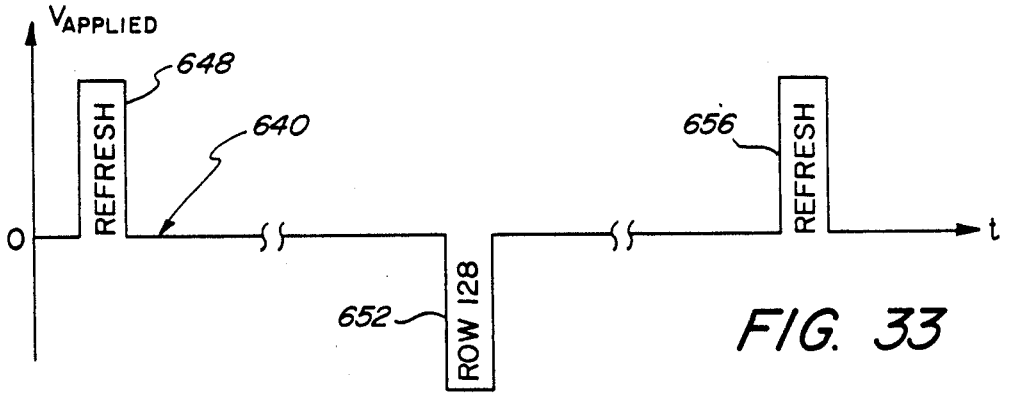
FIG. 33 illustrates an exemplary voltage waveform that represents the voltage applied to an exemplary pixel cell in row 128 of the display panel.
Figure 34:
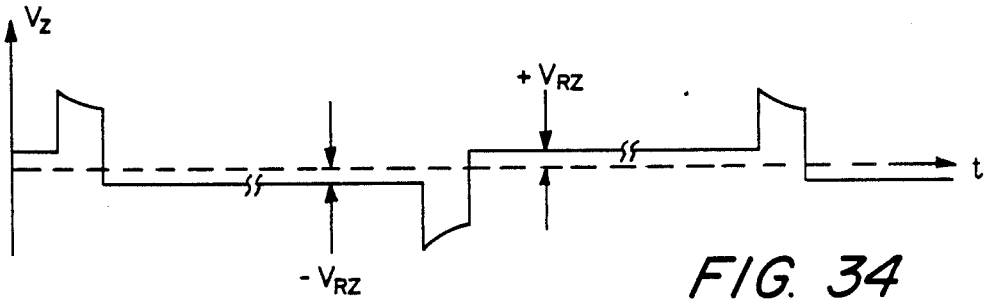
FIG. 34 illustrates an exemplary voltage waveform that represents the voltage across the phosphor layer of an exemplary pixel cell in row 128 in response to the voltage waveform of FIG. 33.

The above-described problem becomes less pronounced towards the middle rows of the display panel 110. For example, FIG. 33 illustrates an exemplary waveform 640 that represents the voltage applied to a pixel cell in row 128 of the display panel 110, and FIG. 34 illustrates an exemplary waveform 644 that represents the voltage across the same pixel cell. As illustrated, a first refresh pulse 648 occurs shortly before row 1 is activated, as discussed above. Thereafter, 127 rows are activated before row 128 is activated by a write pulse 652. After row 128 is activated, 128 rows are activated before the second refresh pulse 656 occurs. Thus, although there is a small difference in the amount of time between the first refresh pulse 648 and the write pulse 652 compared to the amount of time between the write pulse 652 until the second refresh pulse, it can be seen that compared to a pixel cell in one of the upper or lower rows of the display panel 110, an addressed pixel cell in row 128 of the display panel 110 has a residual negative voltage $-V_{RZ}$ across it for approximately the same amount of time that it has a residual positive voltage $+V_{RZ}$. Thus, it is believed that there is no significant long-term average dc voltage across an addressed pixel cell in row 128 to cause the migration and trapping of charges and the reduction in the threshold voltage experienced by the pixel cells in the uppermost and lowermost rows.

Thus, it can be seen that if each row had a substantially symmetrical applied voltage similar to that applied to row 128, the problem with latent images would be substantially reduced or eliminated. This problem has been previously recognized and solutions have been proposed to reduce the latent image problem. For example, one manufacturer of systems using TFEL panels has periodically changed the time location of the refresh pulse with respect to the accesses of the rows of the panel. For example, the first refresh pulse will occur shortly before the access of row 1. After the remaining rows of the panel are accessed, row 1 is again accessed before the next refresh pulse occurs. Thus, the next refresh pulse occurs shortly before the access to row 2. The next refresh pulse occurs shortly before the access to row 3, and so on, until the 256th refresh pulse occurs before row 256. Thereafter, the next refresh pulse occurs before row 1 and the process is repeated. This "stepping" or "rolling" of the refresh pulse requires complicated timing circuitry and it is not clear that the desired symmetry is achieved since the dc voltages across the cells must be averaged across 256 frames of data.

The present invention provides an improved apparatus and method for accessing the rows of a TFEL panel and for timing the refresh pulses to provide a symmetrical dc voltage across the pixel cells of the panel that has an average substantially equal to zero for each of the accessed pixel cells. This dc average of zero is provided over a two-frame period and thus substantially reduces or eliminates the latent image problem caused by charge migration and trapping within the pixel cells. The present invention accomplishes this short-term dc averaging by accessing the row electrodes 182 of the display panel 110 in a first sequential order during one frame and then accessing the row electrodes 182 in a second sequential order during the next frame so that a first row electrode that is accessed before a second electrode in one frame is accessed after the second electrode in the next frame.

Figure 35:
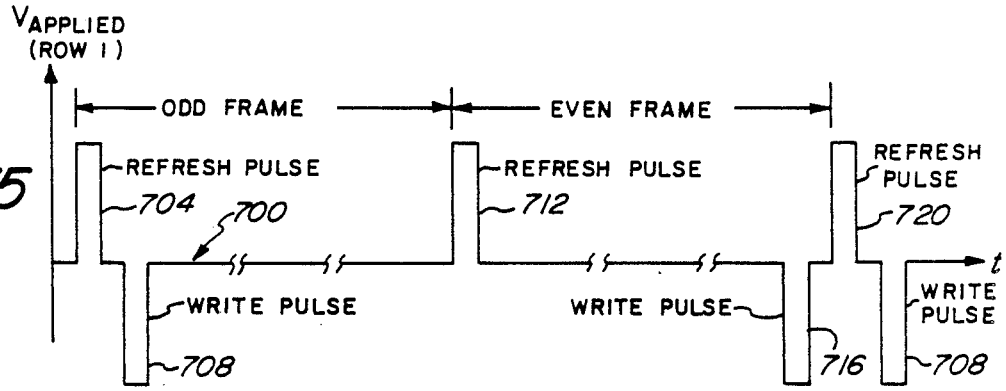
FIG. 35 illustrates an exemplary voltage waveform that represents the voltage applied to an exemplary pixel cell in row 1 of the display panel in accordance with the present invention, showing the symmetry of write pulses with respect to the refresh pulses.

One aspect of the present invention is illustrated in FIGS. 35–48. FIG. 35 illustrates an exemplary waveform 700 that represents the voltage applied to row 1 of the display panel 110 in accordance with the present invention. As illustrated, the waveform 700 represents two frames of access to all the rows of the display panel 110. The first frame, designated in FIG. 35 as an odd frame, includes a first refresh pulse 704, followed by a first write pulse 708. The second frame, designated in FIG. 35 as an even frame, includes a second refresh pulse 712, followed by a second write pulse 716. The second (even frame) is followed by an odd frame that begins with a third refresh pulse 720. It should be understood that the third refresh pulse 720 corresponds to the first refresh pulse 704 and that the foregoing sequence of refresh pulses 704, 712 and write pulses 708, 716 is repeated for each subsequent pair of frames. In FIG. 37, a waveform 730 represents the voltage applied to an exemplary pixel cell in row 2 of the display panel 110. As with the previously described display systems, the present invention applies a common refresh pulse to the entire display panel 110. Thus, the waveform 730 includes refresh pulses that correspond to the refresh pulses of the waveform 700 of FIG. 35 and thus the waveform 730 has the first, second and third refresh pulses indicated by the same numeric designators. It can be seen that the waveform 730 has a first write pulse 734 and a second write pulse 740. The first write pulse 734 occurs one row access time later than the corresponding first write pulse 708 for row 1 (FIG. 35). On the other hand, the second write pulse 740 for row 2 occurs one row access time earlier than the corresponding second write pulse 716 for row 1. This same sequence is repeated for each row in the display panel with the access for each lower row in the odd frames occurring immediately after the access for the row just above it, and with the access for each higher row in the even frames occurring immediately after the access for the row just below it. Thus, the display panel 110 will be scanned downward during the odd frames and will be scanned upward during the even frames. This is further illustrated in FIGS. 39 and 41 for rows 128 and 256, respectively, wherein voltage waveforms 750 and 754 represent the voltages applied to an exemplary pixel cell in each of those rows.

Figure 36:
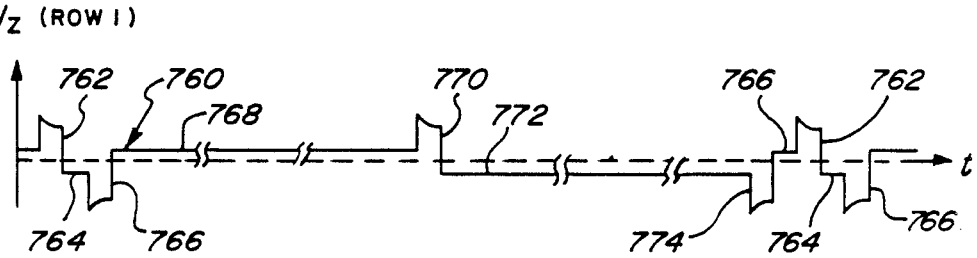
FIG. 36 illustrates an exemplary voltage waveform that represents the voltage across the exemplary pixel cell in row 1 in response to the applied voltage waveform of FIG. 35, showing that the residual voltages across the pixel cell have a dc average substantially equal to zero.
Figure 37:
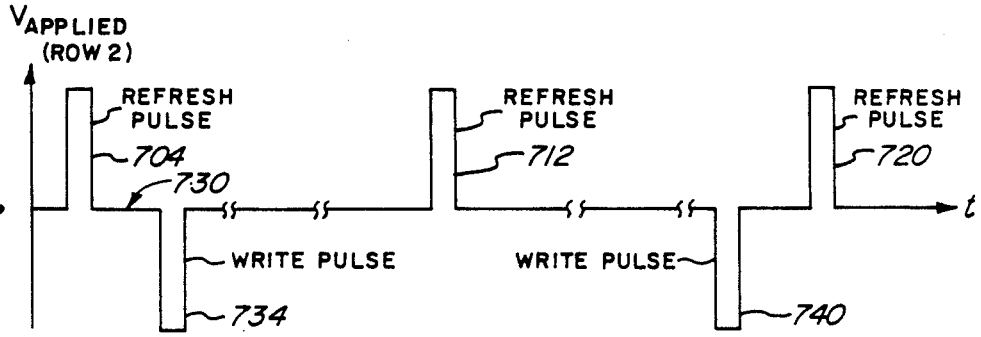
FIG. 37 illustrates an exemplary voltage waveform that represents the voltage applied to an exemplary pixel cell in row 2 of the display panel in accordance with the present invention, showing the symmetry of write pulses with respect to the refresh pulses.
Figure 38:
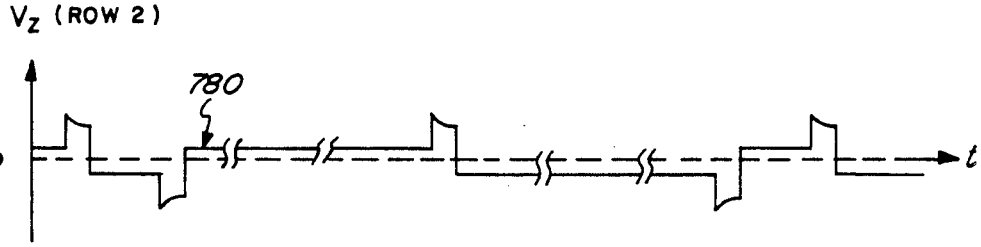
FIG. 38 illustrates an exemplary voltage waveform that represents the voltage across the exemplary pixel cell in row 2 in response to the applied voltage waveform of FIG. 37, showing that the residual voltages across the pixel cell have a dc average substantially equal to zero.
Figure 39:
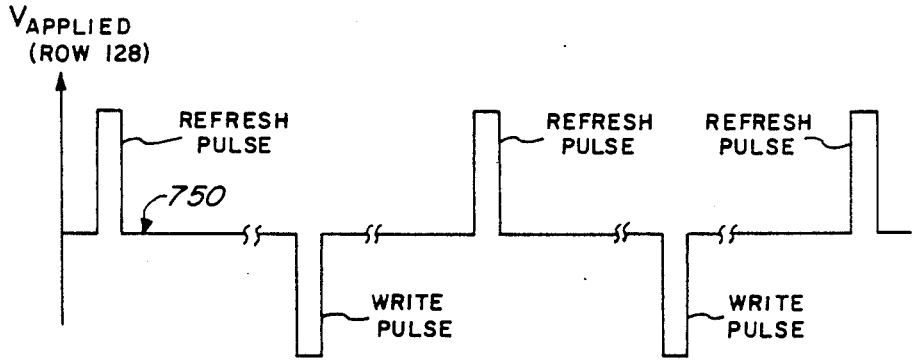
FIG. 39 illustrates an exemplary voltage waveform that represents the voltage applied to an exemplary pixel cell in row 128 of the display panel in accordance with the present invention, showing the symmetry of write pulses with respect to the refresh pulses.
Figure 40:
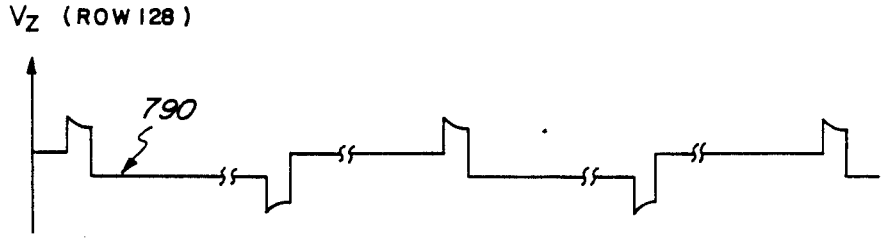
FIG. 40 illustrates an exemplary voltage waveform that represents the voltage across the exemplary pixel cell in row 128 in response to the applied voltage waveform of FIG. 39, showing that the residual voltages across the pixel cell have a dc average substantially equal to zero.
Figure 41:
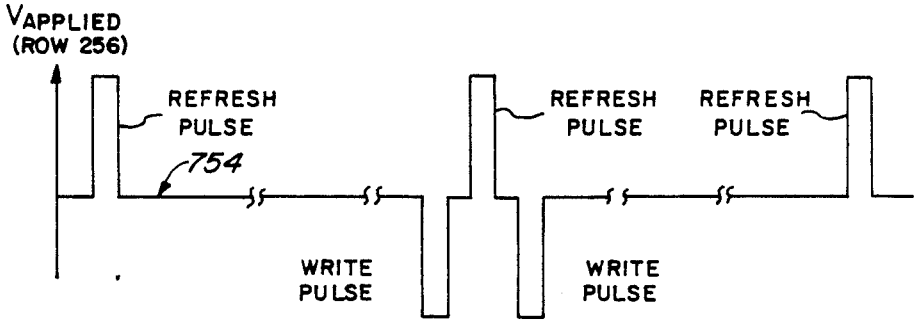
FIG. 41 illustrates an exemplary voltage waveform that represents the voltage applied to an exemplary pixel cell in row 256 of the display panel in accordance with the present invention, showing the symmetry of write pulses with respect to the refresh pulses.
Figure 42:
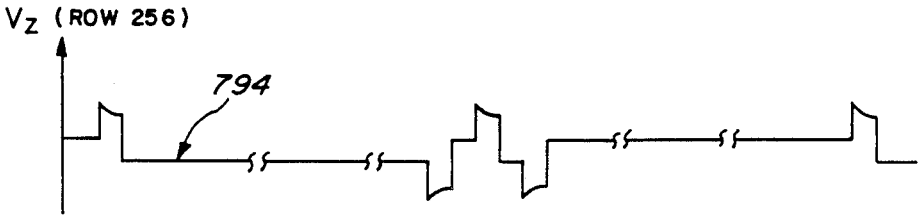
FIG. 42 illustrates an exemplary voltage waveform that represents the voltage across the exemplary pixel cell in row 256 in response to the applied voltage waveform of FIG. 41, showing that the residual voltages across the pixel cell have a dc average substantially equal to zero.

The effect of the above-described scanning system is illustrated in FIGS. 36, 38, 40 and 42. FIG. 36 illustrates a waveform 760 that represents the voltage $V_Z$ across the capacitor $C_Z$ in an exemplary pixel cell in row of the display panel 110 that is responsive to the applied voltage waveform 700 of FIG. 35. As illustrated, the waveform 760 includes a first positive pulse 762 that corresponds to the first refresh pulse 704 of FIG. 35, a first small negative voltage portion 764 that exists between the end of the refresh pulse 704 and the beginning of the first write pulse 708, a first negative pulse 766 that corresponds to the first write pulse 708, a first small positive voltage portion 768 that exists between the end of the first write pulse 708 and the second reset pulse 712, a second positive pulse 770 that corresponds to the second refresh pulse 712, a second small negative voltage portion 772 that exists between the end of the second refresh pulse 712 and the beginning of the second write pulse 716, a second negative pulse 774 that corresponds to the second write pulse 716, and a second small positive voltage portion 776 that exists between the end of the second write pulse 716 and the beginning of the third refresh pulse 720. The waveform 760 then repeats beginning with the third refresh pulse 720. It can be seen that each voltage pulse or level of the waveform 760 during the odd frame is offset by a corresponding negative voltage pulse or level of substantially equal magnitude and duration in the even frame. Thus, the average dc voltage across the pixel cell during the two frames will be substantially equal to zero volts. Similarly, a voltage waveform 780 in FIG. 38 represents the voltage $V_Z$ across an exemplary addressed pixel cell in row 2 responsive to the applied voltage waveform 730 of FIG. 37. Again each voltage level and magnitude of the waveform 780 in the odd frame of the panel scan is offset by a voltage level of substantially the same magnitude and opposite polarity and having substantially the same time duration during the even frame of the panel scan. A voltage waveform 790 in FIG. 40 shows a similar dc averaging effect for an addressed pixel cell in row 128 responsive to the applied voltage waveform 750 of FIG. 39. A voltage waveform 794 shows a similar dc averaging effect for an addressed pixel cell in row 256 responsive to the applied voltage waveform 754 of FIG. 42.

It can be seen from the foregoing that inverting the direction of the scan for the even frames provides an average dc voltage across the pixel cells of each row of the display panel that is substantially equal to zero volts. Thus, the present invention solves the latent image problem described above.

Figure 43:
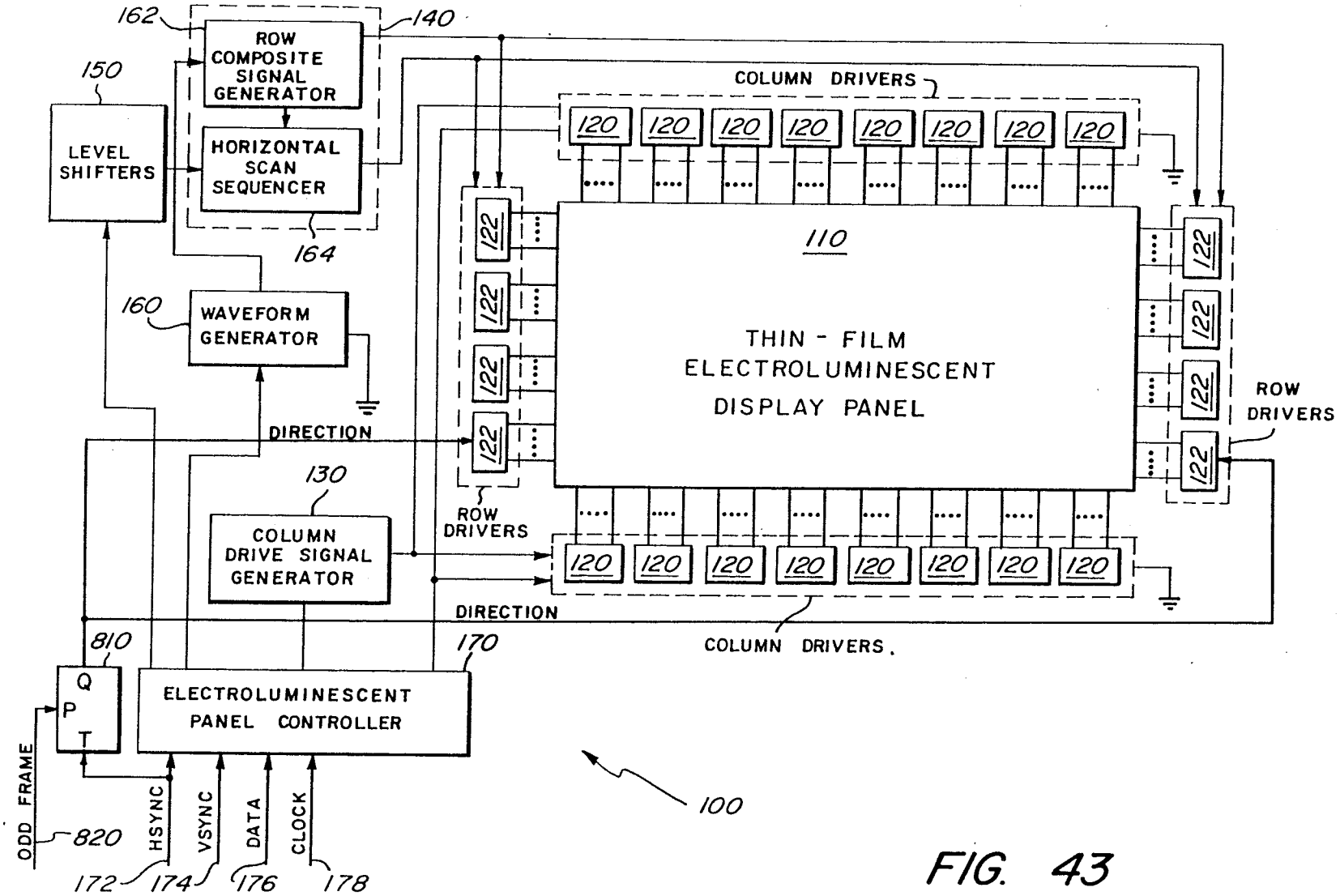
FIG. 43 illustrates a preferred embodiment of the apparatus of the present invention similar to the embodiment of FIG. 1 with the addition of an odd/even frame flip-flop that provides a direction signal that controls the direction in which the row drivers are shifted.

A preferred physical embodiment of the present invention is illustrated in FIG. 43. The embodiment of FIG. 43 is substantially the same as the embodiment of FIG. 1. However, the embodiment of FIG. 43 includes an improvement that selectively activates the row electrodes 182 in accordance with the timing described above. In other words, the embodiment of FIG. 1 generates control signals to activate the row electrodes 182 in sequence from row 1 through row 256 during the odd scan frames and then generates control signals to activate the row electrodes 182 in the inverse sequence from row 256 through row 1 during the even scan frames.

In a preferred embodiment of the present invention, the circuitry of FIG. 43 is similar to the conventional unidirectional circuit described above in connection with FIG. 1. However, the improved embodiment of FIG. 43 includes a toggle flip-flop 810, or the like, that is set during one of the odd or even frames and is reset during the other of the odd or even frames. The present invention includes an odd frame signal on a line 820 that is provided as an input signal from an interface controller (not shown) that indicates when the next vertical synchronization signal on the line 174 corresponds to an odd frame and which presets the flip-flop 810. The output of the toggle flip-flop 810 is provided as a "direction" signal on a line 830 to the shift registers 192 in the row drivers 122 so that the shift registers 192 shift the active data bit in one direction (i.e., from the top of the panel 110 to the bottom of the panel 110 in a conventional manner) for the odd scan frames and so that the shift registers shift the active data bit in the opposite direction for the even scan frames (i.e., from the bottom of the panel 110 to the top of the panel). Thus, the rows will be accessed from row 1 through row 256 during the odd frames and will be accessed from row 256 to row 1 during the even frames.

It should be understood that the data provided to the column drive signal generator 130 must correspond to the correct data for the currently-addressed row. In preferred embodiments of the present invention, the data input to the electroluminescent panel controller 170 via the data line 176 is provided by an interface controller (not shown) that includes an internal buffer memory (not shown) that receives and stores the data from a data generating device such as a computer. The interface controller outputs the data to the electroluminescent panel controller in the order in which it is received for the odd scan frames and outputs the data in reverse row order for the even scan frames. The data in each row is output in the same order irrespective of whether it is for the odd or even frame.

Figure 44:
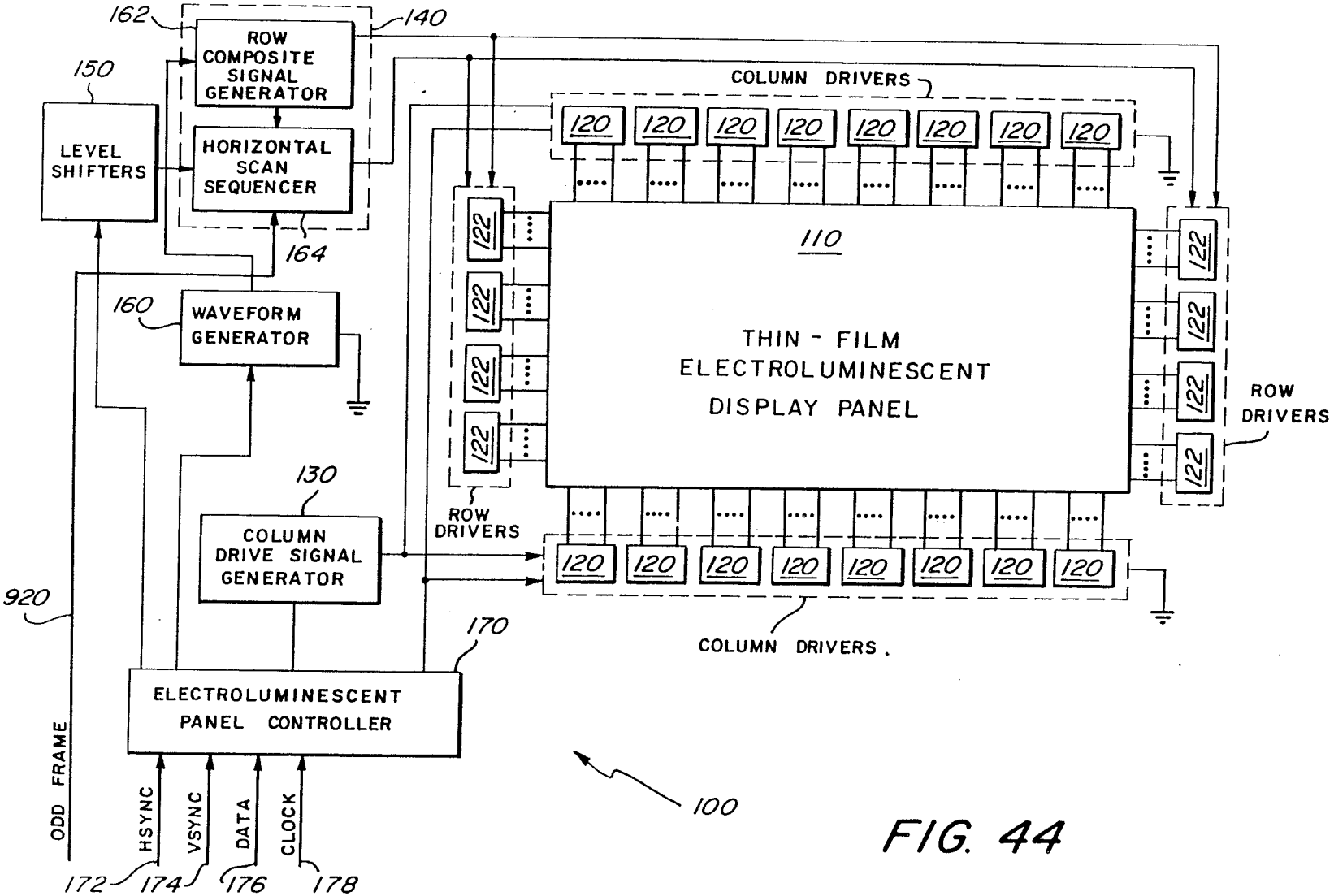
FIG. 44 illustrates a preferred commercial embodiment of the present invention that includes an improved horizontal scan sequencer that controls the operation of the conventional unidirectional row drivers so that the row drivers provide a bidirectional scanning effect.

In a preferred commercial embodiment of the present invention, illustrated in FIG. 44, the conventional HV5122 or HV5222 from Supertex Inc., or an equivalent, such as an SN75551 or SN75552 integrated circuit from Texas Instruments, are used as the row drivers 122. These row drivers 122, which were described above in connection with FIG. 3, do not have bidirectional shifting capability. Thus, the preferred commercial embodiment of the present invention includes an improved horizontal scan sequencer 900 to control the row drivers 122. The horizontal scan sequencer 900 is illustrated in detail in FIG. 45. The horizontal scan sequencer 900 takes advantage of the time between horizontal scans of the display panel 110 to precondition the row drivers 122 to access a selected row during the next horizontal scan time.

Figure 45:
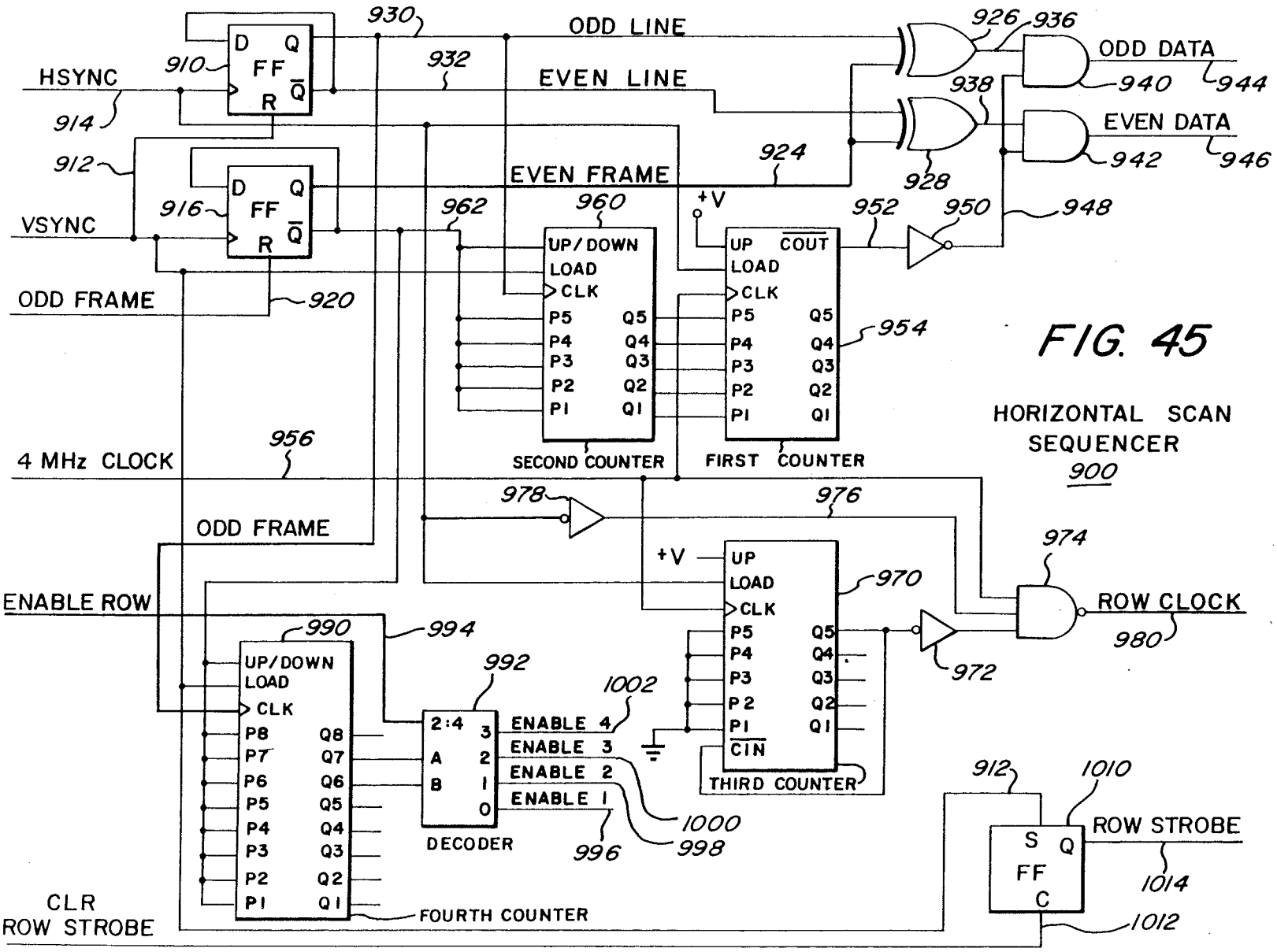
FIG. 45 illustrates a detailed embodiment of the improved horizontal scan sequencer of FIG. 45 showing the flip-flops and counters that control the positioning of an active data bit in the row drivers.

As illustrated in FIG. 45, the horizontal scan sequencer 900 includes an odd/even line flip-flop 910 that is reset upon each occurrence of the vertical synchronization signal (VSYNC) on a line 912 and that is toggled upon each occurrence of the horizontal synchronization signal (HSYNC) on a line 914. Thus, the odd/even line flip-flop 910 will keep track of the number of horizontal synchronization pulses that have occurred since the most recent vertical synchronization pulse. The first horizontal synchronization pulse will cause the odd/even flip-flop to toggle from its reset condition (i.e., the Q-output inactive) to its set condition. Thus, the Q-output will be active for the odd lines that occur subsequent to the vertical synchronization signal. The sequencer 900 further includes an odd/even frame flip-flop 916 that is reset upon each occurrence of the odd frame signal on a line 920 and that is toggled upon each occurrence of the vertical synchronization signal. In the preferred embodiment, the odd frame signal and the vertical synchronization signal occur at substantially the same time. Thus, the Q-output of the odd/even frame flip-flop 916 will be inactive for the odd frames and active for the even frames. Together, the odd/even line flip-flop 910 and the odd/even frame flip-flop 916 keep track of which row is to be activated next. The Q-output of the odd/even frame flip-flop 916 on a line 924 is an "even frame" signal that is active for even frames and is inactive for odd frames. The even frame signal is provided as an one input to each of a first exclusive-OR gate 926 and a second exclusive-OR gate 928. The other input to the first exclusive-OR gate 926 is the "odd line" signal on a line 930 that is connected to the Q-output of the odd/even line flip-flop 910. The other input to the second exclusive-OR gate 926 is an "even line" signal on a line 932 that is connected to the NOT-Q-output of the odd/even line flip-flop 910. Thus, the output of the first exclusive-OR gate 926 on a line 936 will be high when the even frame signal on the line 924 is inactive and the odd line signal on the line 930 is active. The output of the second exclusive-OR gate 928 on a line 938 will have the opposite logic state. Thus, when a frame is odd (i.e., the rows are scanned from top to bottom), the output of the first exclusive-OR gate 926 will be active first, followed by the output of the second exclusive-OR gate 928, and then toggling back and forth with each subsequent horizontal synchronization signal. In contrast, when the frame is even (i.e., the rows are scanned from the bottom to the top), the output of the second exclusive-OR gate 928 will be active first, followed by the output of the first exclusive-OR gate 926, and then toggling back and forth with each subsequent horizontal synchronization signal.

The outputs of the exclusive-OR gates 926 and 928 are connected to one input each of first and second NAND-gates 940 and 942, respectively. The output of the first NAND-gate 940 is provided on an output line 944 and is designated as "odd data". The output of the second NAND-gate 942 is provided on an output line 946 and is designated as "even data". The second inputs of each of the AND-gates 940 and 942 are connected together and connected via a line 948 to the output of an inverter 950 which has its input connected via a line 952 to the active-low carry output of a first counter 954 that is connected as a modulo-32 counter. Whenever the first counter 954 reaches a count that is a multiple of 32, the carry output will be active low and one or the other of AND-gates 940 or 942 will have an active output on either the line 944 or the line 946, respectively, depending upon the states of the exclusive-OR gates 926 and 928. The load control input of the first counter 954 is connected to the horizontal synchronization signal on the line 914. Thus, the first counter 954 is loaded with a predetermined count upon each occurrence of the vertical synchronization signal. The clock input of the first counter 954 is connected to a 4 MHz clock signal on a line 956 so that the first counter 954 is incremented once for each cycle of the clock signal. The predetermined count loaded into the first counter 954 is provided by the outputs of a second counter 960.

The second counter 960 is also a modulo-32 counter. The second counter 960 has its clock input connected to the odd line signal on the line 930 and has its load control input connected to the vertical synchronization signal on the line 912. The second counter 960 has an up/down control input that determines which direction it will count that is connected to the NOT-Q-output of the odd/even frame flip-flop 916 on a line 962. The second counter 960 has five data inputs that are also connected to the line 962. Thus, the up/down control input and the data inputs will be high on odd frames and low on even frames. Therefore, the second counter 960 will either count up or count down, depending upon whether the NOT-Q-output of the odd/even frame flip-flop 916 on a line 962 is active. When the frame is odd, the line 962 will be active. Therefore, during odd frames, the second counter 960 will count up from a count of 31 (decimal), and during even frames the second counter 960 will count down from a count of zero. The counting will occur with every other occurrence of the horizontal synchronization signal and thus will occur after every other row access. The second counter 960 therefore counts the number of pairs of rows that have been accessed since the most recent vertical synchronization signal. The count is modulo-32, which corresponds to the number or rows that are controlled by each of the row driver circuits 122, described above.

When a horizontal synchronization signal occurs, the current count in the second counter 960 is transferred to the first counter 954. Thereafter, the first counter 954 will be incremented by the 4 MHz clock. The first counter 954 will provide an active carry out signal on the line 948 at a count that depends upon the count loaded into it. For example, if the odd/even flip-flop 916 is reset to an odd frame (i.e., line 962 is active), and a vertical synchronization signal has just occurred followed by the first horizontal synchronization signal, then the count loaded into the first counter 954 from the second counter 960 will be a zero. Thus, the counter 954 must be incremented 31 times before the carry output on the line 948 becomes active. In contrast, if the horizontal synchronization signal has occurred 32 times (or a multiple of 32 times) since the last vertical synchronization pulse, then the count loaded into the first counter 954 will be 31 ((31-32)modulo-32). Thus, the carry output of the second counter 954 will be immediately active. Similarly, if an even frame is in progress, and only the first horizontal synchronization signal has occurred since the last vertical synchronization signal, the count loaded into the first counter 954 from the second counter 960 will be 31. Thus, although only one horizontal synchronization signal has occurred, the carry output of the first counter 954 will be immediately active.

The horizontal scan sequencer 900 of FIG. 45 further includes a third counter 970 that is preloaded with a count of zero by the occurrence of each horizontal synchronization signal and which is incremented once for each cycle of the 4 MHz clock on the line 956. The third counter 970 is a 5-bit counter that includes feedback from the 5th bit output to an active low carry input so that the third counter 970 counts to 32 and stops until reloaded at the next synchronization signal. The 5th bit output of the third counter 970 is inverted by an inverter 972 and is provided as an enabling input to a NAND-gate 974. The NAND-gate 974 also has an enabling input connected to a line 976 that is connected to the output of an inverter 978. The input to the inverter 978 is connected to the horizontal synchronization signal on the line 914. Thus, the two inputs of the NAND-gate 974 will be active high so long as the horizontal synchronization signal is not present and so long as the 5th bit output of the third counter 970 is not active. The NAND-gate 974 has a third input that is connected to the line 956 and thus receives the 4 MHz clock signal. It can thus be seen that the output of the NAND-gate 974 on a line 980 will provide 32 clock pulses that begin after the occurrence of each horizontal synchronization signal.

The horizontal scan sequencer 900 of FIG. 45 further includes a fourth counter 990 that is preferably an eight-bit binary up/down counter having eight output signals. The sixth and seventh output signals of the fourth counter 990 are connected to the input of a two-line to four line decoder 992. The decoder 992 provides one of four active outputs in accordance with the four possible states of the sixth and seventh output signals of the fourth counter 990. The selected output of the decoder 992 is enabled by an active row enable signal on a line 994. The row enable signal is provided as an output of the electroluminescent panel controller circuit 170 (FIGS. 1 and 44) to enable a selected row driver 122 during a write pulse. The fourth counter 990 has a clock input connected to the odd line signal on the line 930 so that the fourth counter is either incremented or decremented by every other horizontal synchronization signal. The fourth counter 990 has an up/down control input that is connected to the odd frame signal on the line 962 so that it increments during odd frames and decrements during even frames. The fourth counter 990 further includes eight preset inputs that are also connected to the odd frame signal on the line 962. The fourth counter 990 has a load control input that is connected to the vertical synchronization signal on the line 912. Thus, during odd frames, the fourth counter 990 is preloaded with all ones and then counts up once for each occurrence of the odd line signal on the line 930. Since the odd line signal on the line 930 will occur on the occurrence of the first horizontal synchronization signal after the vertical synchronization signal, the fourth counter 990 will effectively start the odd frames with a count of zero. This count will be decoded by the decoder 992 to enable an output on a line 996 designated as enable 1. As will be seen below, enable 1 enables the row drivers for the first 64 rows of the display panel 110. After 32 additional counts, the sixth output (Q6) will become active, and the decoder 992 will enable an output on a line 998, designated as enable 2, which enables the row drivers for the second 64 rows of the display panel 110. Thirty-two more counts causes the decoder 992 to enable a line 1000 designated as enable 3, and thirty-two counts afterward, the decoder 992 enables a line 1002, designated as enable 4. When an even frame is in progress, the fourth counter is preset to zero and counts downward. The first horizontal synchronization signal after the vertical synchronization signal decrements the counter to all ones so that the decoder 992 enables the enable 4 signal on the line 1000. Subsequent groups of 32 counts cause the enable 3 signal on the line 998 to be enabled, followed by the enable 2 signal on the line 996, followed by the enable 1 signal on the line 994.

The horizontal scan sequencer 900 further includes a set/reset flip-flop 1010 that is set by the occurrence of the vertical synchronization signal on the line 912 and that is reset by the occurrence of a clear row strobe signal on a line 1012. The clear row strobe signal on the line 1012 is provided as an output of the electroluminescent panel controller 170 (FIGS. 1 and 44) in a conventional manner. The output of the set/reset flip-flop 1010 on a line 1014 is provided as a control input to the row drivers 122.

Figure 46:
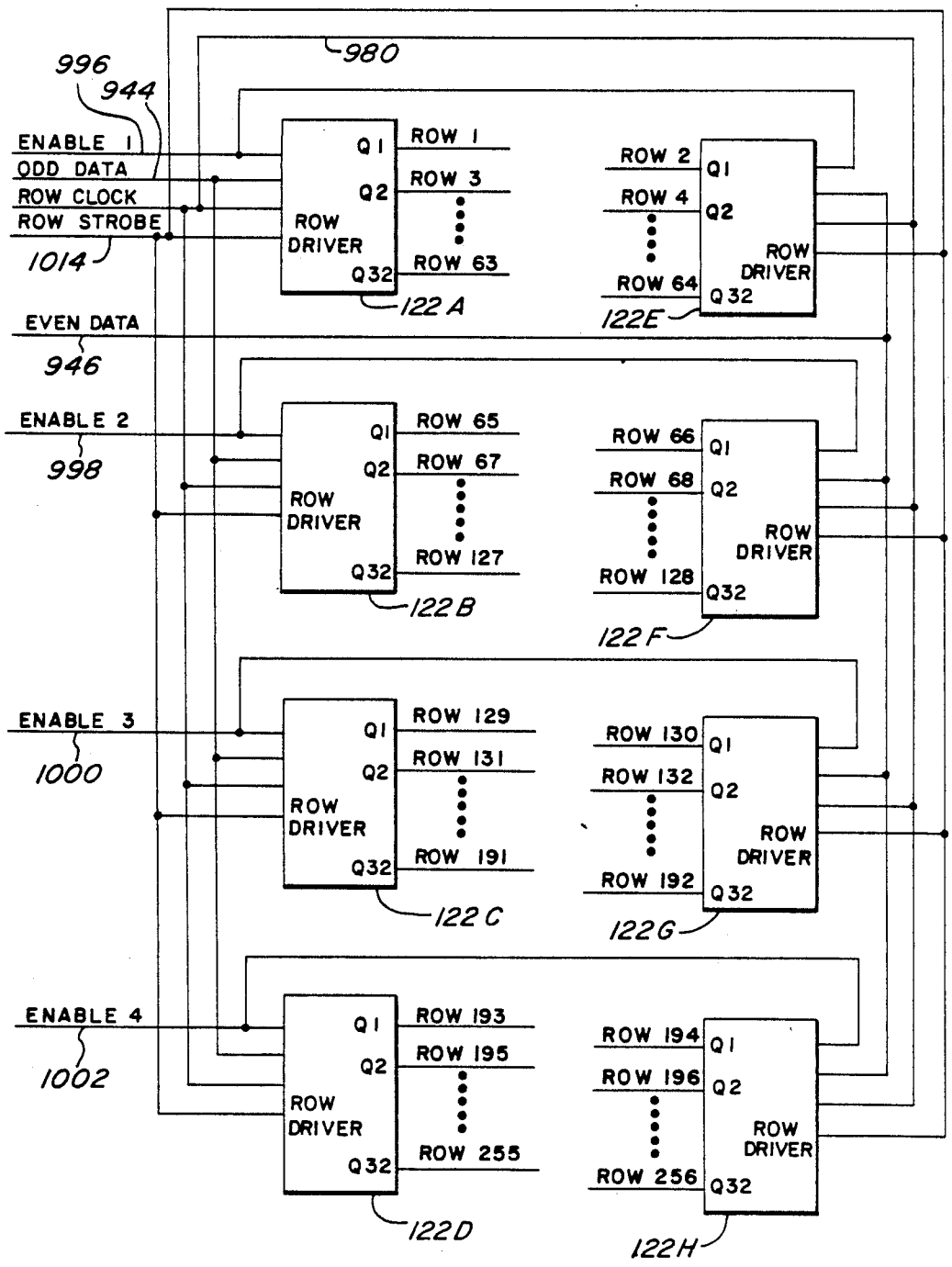
FIG. 46 illustrates an interconnection diagram for the odd and even row drivers of the preferred commercial embodiment of present invention.

The purpose for varying the time at which the carry output is active and thus the time at which either the output of the AND-gate 940 or the output of the AND-gate 942 is active can be better understood by first referring to the interconnection of the row drivers as illustrated in FIG. 46. As discussed above, there are eight row drivers, with four of the row drivers, designated as 122A, 122B, 122C, and 122D driving the row electrodes for the odd rows, ROW 1, ROW 3, ROW 5, . . . ROW 255, and the other four row drivers, designated as 122E, 122F, 122G, and 122H, driving the row electrodes for the even rows, ROW 2, ROW 4, ROW 6, . . . ROW 256. The odd row drivers 122A, 122B, 122C, and 122D have their data inputs connected to the odd data line 944, and the even row drivers 122E, 122F, 122G, and 122H have their data inputs connected to the even data line 946.

The first odd row driver 122A controls the activation of the first 32 odd rows, namely rows 1, 3, 5, . . . 61, 63. The first even row driver 122E controls the activation of the first 32 even rows, namely rows 2, 4, 6, . . . 62, 64. The enable inputs of the first odd row driver 122A and the first even row driver 122E are connected together and are connected to the enable 1 line 996.

The second odd row driver 122B controls the activation of the second 32 odd rows, namely rows 65, 67, . . . 125, 127. The second even row driver 122F controls the activation of the second 32 even rows, namely rows 66, 68, . . . 126, 128. The enable inputs of the second odd row driver 122B and the second even row driver 122F are connected together and are connected to the enable 2 line 998.

The third odd row driver 122C controls the activation of the third 32 odd rows, namely rows 129, 131, . . . 189, 191. The third even row driver 122G controls the activation of the third 32 even rows, namely rows 130, 132, . . . 190, 192. The enable inputs of the third odd row driver 122C and the third even row driver 122G are connected together and are connected to the enable 3 line 1000.

The fourth odd row driver 122D controls the activation of the fourth 32 odd rows, namely rows 193, 195, 253, 255. The fourth even row driver 122H controls the activation of the fourth 32 even rows, namely rows 194, 196, . . . 254, 256. The enable inputs of the fourth odd row driver 122D and the fourth even row driver 122H are connected together and are connected to the enable 4 line 1002.

The row clock inputs of all eight row drivers are connected together and are connected to the row clock signal on the line 980. Similarly, the row strobe inputs of all eight row drivers are connected together and are connected to the row strobe signal on the line 1014.

The row to be activated depends upon the number of occurrences of the horizontal synchronization signal since the most recent vertical synchronization signal and also depends upon which direction the panel is being scanned (i.e., whether an odd frame or an even frame is in progress). In previously known display panels that scan in only one direction, the four row drivers in each set (i.e., the four odd drivers and the four even drivers) were serially interconnected and a data bit was introduced to the data input of the first row driver and propagated through the row drivers on every other occurrence of the horizontal synchronization signal. However, this interconnection cannot be used with the inverted even frame scan of the present invention. Thus, the data bit is selectively loaded into the correct row location of the row drivers at each occurrence of the horizontal synchronization signal by inputting the data bit at the correct time during a 32-bit shift of the shift registers within the row drivers so that at the conclusion of the 32-bit shift, the data bit is in the correct location. For example, if the data bit is to be at the Q1 output of one of the row drivers, the data bit is introduced at the input of the shift register immediately preceding the occurrence of the 32nd shift pulse so that it is shifted only once into the first stage of the 32-bit shift register. On the other hand, if the data bit is to be at the Q32 output of one of the row drivers, the data bit is introduced at the input of the shift register immediately preceding the occurrence of first shift pulse so that it is shifted 32 times to the last stage of the 32-bit shift register.

Figure 47:
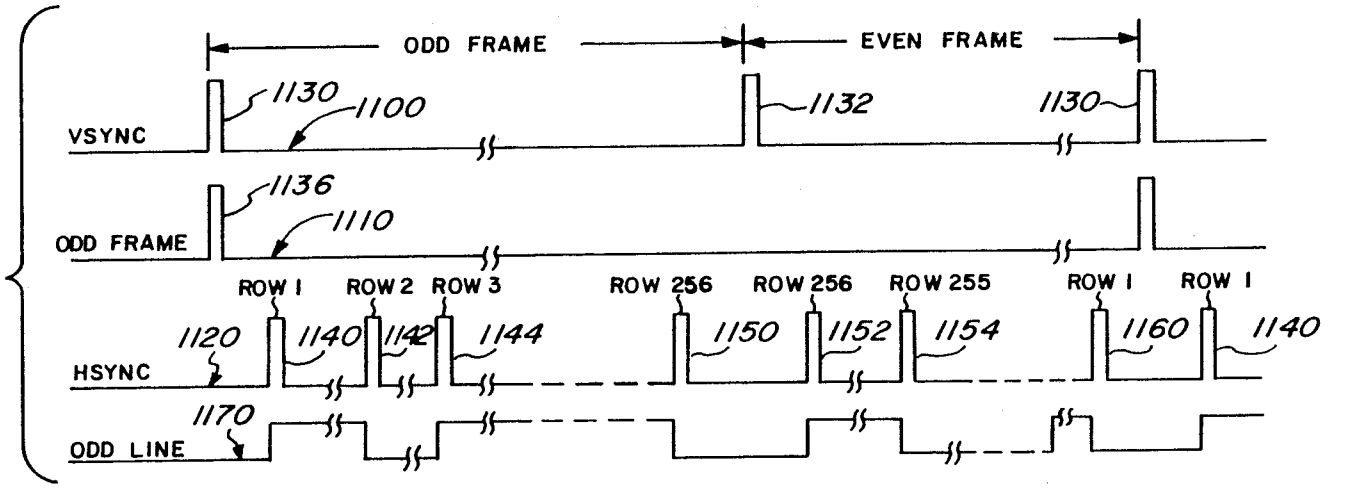
FIG. 47 illustrates exemplary voltage waveforms for the horizontal synchronization signal, the vertical synchronization signal, the odd frame signal and the odd line signal in the preferred embodiment of the invention.
Figure 48:
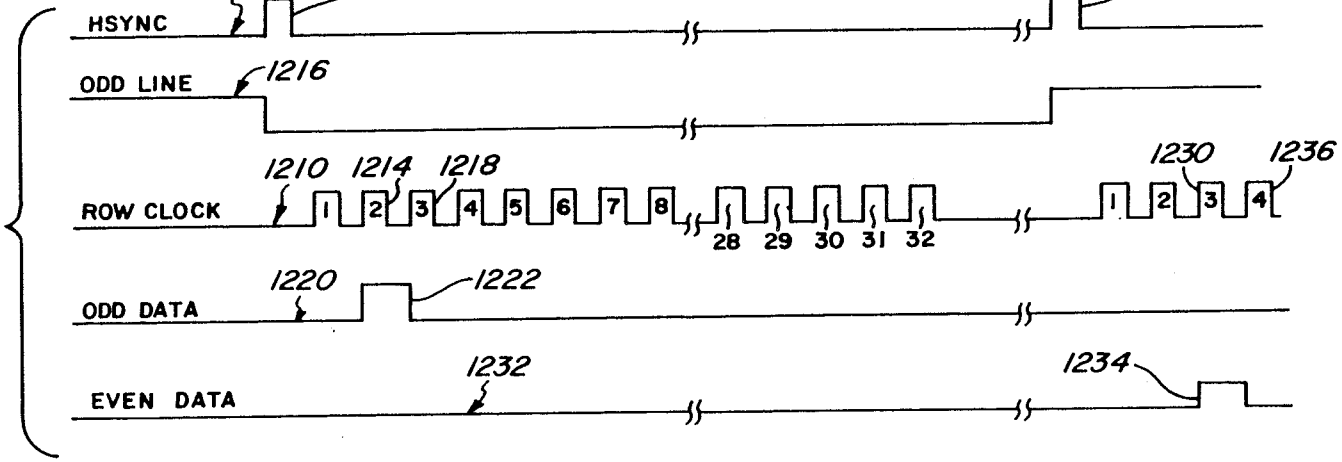
FIG. 48 illustrates exemplary voltage waveforms for the horizontal synchronization signal, the odd line signal, the row clock, the odd data signal and the even data signal, showing the positioning of the odd data bit to access row 59 of the display panel, followed by the positioning of the even data bit to access row 58 of the display panel.

The foregoing is illustrated by timing charts in FIGS. 47 and 48. FIG. 47 shows a vertical synchronization signal waveform 1100 in time relationship to an odd frame waveform 1110 and a horizontal signal waveform 1120. As illustrated, a first vertical synchronization pulse 1130 occurs at the beginning of an odd frame and a second vertical synchronization pulse 1132 occurs at the beginning of an even frame. An odd frame pulse 1136 occurs in the odd frame waveform 1110 at substantially the same time as the first vertical synchronization pulse 1130 and thus designates the beginning of the odd frame. After the first vertical synchronization pulse 1130 occurs, a first horizontal synchronization pulse 1140 occurs to mark the beginning of the first row of data. It is followed by a second horizontal synchronization pulse 1142 to mark the beginning of the second row and a third horizontal synchronization pulse 1144 to mark the beginning of the third row. At the end of the odd frame, a 256th horizontal synchronization pulse 1150 marks the beginning of the 256th row. Thereafter, the second vertical synchronization pulse 1132 occurs. Since the second vertical synchronization pulse 1132 is not accompanied by an odd frame pulse, the second vertical synchronization pulse marks the beginning of the even frame of data. Thus, the next horizontal synchronization pulse 1152 marks the beginning of the 256th row as the scanning of the even frames begins at the bottom of the display panel 110. The next horizontal synchronization pulse 1154 marks the beginning of the 255th row of data. The last horizontal synchronization pulse 1160 in the even frame of data marks the beginning of the 1st row of data (i.e., the uppermost row of data).

A waveform 1170 in FIG. 47 represents the odd line output of the odd/even flip-flop 910 on the line 930 in FIG. 45. As illustrated, the odd line signal is active for the first row accessed in each frame irrespective of whether the frame is an odd or even frame.

FIG. 48 illustrate waveforms to help further explain the operation of the row clock and the odd and even data signals of FIG. 45. In FIG. 48, a horizontal synchronization waveform 1200 is illustrated that has a first horizontal synchronization pulse 1204 and a second horizontal synchronization pulse 1208. A waveform 1210 represents the 4 MHz clock signal on the line 956 in FIG. 45. In FIG. 48, it is assumed that the first horizontal synchronization pulse 1204 marks the beginning of the 59th row of data from the top in the even frame. Thus, 197 horizontal rows of data have already been written in this frame starting at the bottom of the display panel 110. When the first horizontal synchronization pulse 1204 occurs, the first counter 954 (FIG. 45) is loaded with the output of the second counter 960. In this example, the second counter 960 will have counted down from 31 three full times and will have counted down a fourth time to a value of 29 (i.e., once when the active row switched from 63 to 62, and once when the active row switched from 61 to 60). Thus, a count of 29 will be loaded into the first counter 954 when the first horizontal synchronization pulse 1204 occurs. Thereafter, the occurrences of the 4 MHz clock on the line 956 increments the first counter 954. The leading edge of the 2nd clock signal (designated as 1214) increments the first counter 954 to a value of 31 and thus causes the carry output signal on the line 952 to be active. Since this is an even line of the even frame, the odd line signal output on the line 930, represented by a waveform 916 in FIG. 48, will be inactive and the NAND-gate 1220 will be enabled by the exclusive-OR gate 926. Thus, the odd data signal on the line 944 will be active as illustrated by a pulse 1222 on a waveform 1220 in FIG. 48. The leading edge of the next occurrence of the 4 MHz clock signal (designated as 1218) will gate the odd data signal into the odd row drivers 122A, 122B, 122C, and 122D. Thereafter, there will be 29 additional 4 MHz clock pulses to shift the odd data signal to the 30th data outputs of the internal shift registers of the odd row drivers 122A, 122B, 122C and 122D where it will remain until 4 MHz clock is again activated after the next horizontal synchronization pulse. Since the current row is the 59th row, the fourth counter 990 (FIG. 45) will have counted down to a value such that the Q7 and Q6 outputs are both zero. Thus, the decoder 992 will generate an active signal on the enable 1 line 996 when the enable row pulse on the line 994 is active. Thus, only the first odd row driver 122A will be activated. Therefore, only the row 59 electrode will be activated to allow writing of the pixel cells on that row.

When the second horizontal synchronization pulse 1208 occurs, the odd/even line flip-flop 910 will change states so that the odd line signal on the line 930 becomes active as illustrated by the change in the level of the waveform 1216 in FIG. 48. Furthermore, the activation of the odd line signal on the line 930 decrements the second counter 960 so that it now has a count of 28. This count is loaded into the first counter 954. Thus, the first counter 954 will be incremented three times before its carry output becomes active. Thus, the leading edge of the third 4 MHz clock pulse (designated as 1230 in FIG. 48) will provide an active input to the two NAND-gates 940 and 942. However, only the NAND-gate 942 is enabled because of the active state of the odd line signal on the line 930. Thus, the even data signal on the line 946 will be activated as illustrated by a pulse as illustrated by a pulse 1234 on a signal waveform 1232 in FIG. 48. The even data signal is shifted into the even row drivers 122E, 122F, 122G, and 122H on the occurrence of the fourth 4 MHz clock pulse (designated as 1236 in FIG. 48). The remaining twenty-eight 4 MHz clock pulses will shift the even data signal to the 29th position in the even row drivers so that row 58 is enabled when the enable row pulse is activated on the line 994.

From the foregoing, it can be seen that the present invention can be implemented utilizing commercially available row drivers.

The foregoing invention will provide significant improvements over a conventional panel when the magnitude of the write voltage is varied in order to provide varying levels of light intensity in applications requiring gray scale capability. For example, in an exemplary embodiment of the present invention, the refresh pulse typically has a voltage magnitude of +200 volts and the combined write pulse and column pulse has a voltage magnitude of −200 volts, thus providing the symmetrical dc voltages when operated in accordance with the present invention. The light intensity can be increased by increasing the write voltage magnitude, for example, to −210 volts, or decreased by decreasing the write voltage magnitude, for example, to −190 volts. Although variations in write voltage magnitude will introduce a non-zero average dc voltage across a pixel cell of the present invention, calculations show that the non-zero average dc voltage is substantially less than the average dc voltage of a conventional panel that does not have the symmetrical scanning system of the present invention.

Although described above in accordance with preferred embodiments of the present invention, it should be understood that modifications to the described embodiments can be made without going beyond the scope of the present invention as defined in the appended claims.

What is claimed is:

1. In an electroluminescent display system having a display panel, said display panel having a plurality of column electrodes and having a plurality of row electrodes, a plurality of light-emitting pixel elements at the intersections of said column electrodes and said row electrodes, said pixel elements responsive to write pulses having a first polarity voltage applied to said row electrodes and refresh pulses having a second polarity voltage applied to said row electrodes, a method of applying said write pulses and said refresh pulses to said row electrodes comprising the steps of:

applying first, second and third refresh pulses to said row electrodes at fixed time intervals, the time interval between said first refresh pulse and said second refresh pulse comprising a first display frame, the time interval between said second refresh pulse and said third refresh pulse comprising a second display frame;

applying a first sequence of write pulses to said plurality of row electrodes, one at a time, during said first display frame between said first refresh pulse and said second refresh pulse, each of said write pulses in said first sequence applied at respective first time intervals after said first refresh pulse, said first time interval for each of said row electrodes proportional to the position of said row electrode with respect to the top of said display panel;

applying a second sequence of said write pulses to said row electrodes, one at a time, during said second display frame after said second refresh pulse, each of said write pulses in said second sequence applied at respective second time intervals with respect to said second refresh pulse, the second time interval for each of said row electrodes different from the corresponding first time interval for each of said row electrodes, such that the second time interval for each of said row electrodes is proportional to the position of said row electrode with respect to the bottom of said display panel.

2. The method as defined in claim 1, wherein said first sequence of write pulses comprises write pulses applied to said row electrodes in order from the top of said display panel to the bottom of said display panel during said first display frame and said second sequence of write pulses comprises write pulses applied to said row electrodes in reverse order from the bottom of said display panel to the top of said display panel during said second display frame.

3. The method as defined in claim 1, wherein the application of a refresh pulse to one of said pixel elements causes a residual dc voltage of a first polarity across said pixel element that remains until the next write pulse, and the application of a write pulse to said pixel element causes a residual dc voltage of a second polarity across said pixel element that remains until the application of the next refresh pulse to said pixel element, and wherein said first and second sequences cause the amount of time that said residual dc voltage of said first polarity remains across said pixel element during the total time of said first and second frames to be substantially equal to the amount of time that said residual dc voltage of said second polarity remains across said pixel element during the total time of said first and second frames.

4. An electroluminescent display system, comprising:

a thin-film electroluminescent display panel having an electroluminescent phosphor layer and a plurality of row electrodes and column electrodes that define pixel cells on said display panel;

a plurality of column drivers that apply column voltages to said column electrodes;

a plurality of row drivers that apply row voltages to said row electrodes;

a column driver control circuit that controls the application of said column voltages to said column electrodes by said column drivers; and a row driver control circuit that controls the application of said row voltages to said row electrodes by said row drivers, said row driver control circuit comprising:

a first circuit that generates a plurality of refresh pulses having a first voltage polarity and spaced apart in time by fixed time intervals, the time interval between a first refresh pulse and a second refresh pulse comprising a first display frame, the time interval between said second refresh pulse and a third refresh pulse comprising a second display frame, said refresh pulses applied to said plurality of row electrodes; and a second circuit that enables said row drivers to apply write voltage pulses to each of said row electrodes, one at a time, said second circuit enabling said row drivers in a first sequence during said first display frame so that said row electrodes are enabled in a first order during said first display frame and so that said row electrodes are enabled in a second order during said second display frame, said first and second orders selected so that for any one of a plurality of row electrodes, the amount of time between the occurrence of a write pulse on said any one row electrode in said first display frame and the occurrence of said second refresh pulse is substantially equal to the amount of time between the occurrence of said second refresh pulse and the occurrence of a write pulse on said any one electrode in said second display frame;

wherein said write voltage pulses are applied to said row electrodes in order from the top of the display panel to the bottom of the display panel during said first display frame and said write voltage pulses are applied to said row electrodes in order from the bottom of said display panel to the top of said display panel during said second display frame.

5. In an electroluminescent display system having a display panel that includes thin, electroluminescent phosphor layer and a plurality of row electrodes and column electrodes defining pixel elements on said display panel, a method of reducing the residual dc voltages across said pixel elements comprising the steps of:

applying a sequence of refresh pulses having a first voltage polarity to said row electrodes at fixed, spaced-apart intervals;

between a first of said refresh pulses and a second of said refresh pulses, applying a first sequence to write voltages having a second voltage polarity to said row electrodes in a first order from the top of said display panel to the bottom of said display panel; and between said second of said refresh pulses and a third of said refresh pulses, applying a second sequence of write voltages to said row electrodes in a second order from the bottom of said display panel to the top of said display panel, said first order and said second order selected so that the sum of the amount of time between said first refresh pulse and the write voltage applied to any one of said row electrodes in said first sequence added to the amount of time between the second refresh pulse and the write voltage applied to said any one of said row electrodes in said second sequence is substantially equal to the amount of time between said first refresh pulse and said second refresh pulse.

6. A method of reducing the residual dc voltages across the pixel elements of a thin-film electroluminescent display panel, said display including a plurality of row electrodes and a plurality of column electrodes, said row electrodes and said column electrodes crossing to define said pixel elements, said row electrodes driven by a plurality of row drivers, said method comprising the steps of:

applying a sequence of refresh pulses to said plurality of row electrodes, said refresh pulses each comprising a voltage of a first polarity, each said refresh pulse applied to all of said plurality of row electrodes at substantially the same time, adjacent ones of said refresh pulses spaced apart in time from each other by a fixed amount of time, the fixed amount of time between adjacent refresh pulses defining a display frame;

applying a plurality of sequences of write pulses, one at a time, to said plurality of row electrodes during each said display frame, said write pulses comprising a voltage of a second polarity different from said first plurality, said plurality of sequences of write pulses repeating after a like plurality of display frames, said plurality of sequences selected so that over said plurality of display frames, for each row electrode the total time from the refresh pulses in the display frames to the next adjacent write pulses is substantially equal to the total time from the write pulses in the display frame to the next adjacent refresh pulses, the number of sequences in said plurality of sequences substantially less than the number of said plurality of row electrodes;

wherein said number of sequences is equal to two.

7. The method as defined in claim 6, wherein said number of row electrodes is equal to 256.

* * * * *

UNITED STATES PATENT AND TRADEMARK OFFICE

CERTIFICATE OF CORRECTION

PATENT NO. : 4,975,691

DATED : December 4, 1990

INVENTOR(S) : James Y. Lee

It is certified that error appears in the above-indentified patent and that said Letters Patent is hereby corrected as shown below:

In Column 16, Line 58, change "The X voltage" to --The voltage--.

In Column 18, Line 47, change "$(-(V_1/b-V_{TH}))$ to --$(-(V_1/3-V_{TH}))$--.

In Column 19, Line 26, change "$(V_1/3V_{TH})$" to --$(V_1/3-V_{TH})$--.

In Column 24, Line 37, change "in row of" to --in row 1 of--.

Signed and Sealed this

Twenty-ninth Day of June, 1993

Michael K. Kirk

MICHAEL K. KIRK

*Acting Commissioner of Patents and Trademarks*

*Attest:*

*Attesting Officer*